US006095639A

United States Patent [19]

Uetsuki et al.

[11] Patent Number: 6,095,639

[45] Date of Patent: Aug. 1, 2000

[54] METHOD FOR PRESERVING A LIQUID-EJECTION HEAD, AND LIQUID-EJECTION APPARATUS

[75] Inventors: Masaya Uetsuki, Yokohama; Toshio Kashino, Chigasaki; Hiroshi Tajika, Yokohama; Osamu Iwasaki, Tokyo; Hidehiko Kanda, Kawasaki; Yoshie Asakawa, Hotaka-machi, all of Japan

[73] Assignee: Canon Kabushiki Kaisha, Tokyo, Japan

[21] Appl. No.: 08/890,333

[22] Filed: Jul. 9, 1997

[30] Foreign Application Priority Data

Jul. 9, 1996 [JP] Japan ..... 8-179585

[51] Int. Cl.[7] ..... B41J 2/05

[52] U.S. Cl. ..... 347/65

[58] Field of Search ..... 347/65, 22, 28, 347/44, 84, 85, 89, 154, 103, 111, 159, 127, 128, 17, 141, 120, 151

[56] References Cited

U.S. PATENT DOCUMENTS

| | | | |
|---|---|---|---|
| 4,380,770 | 4/1983 | Maruyama | 347/89 X |
| 4,480,259 | 10/1984 | Kruger et al. | 347/63 |
| 4,723,129 | 2/1988 | Endo et al. | 347/56 |
| 4,987,429 | 1/1991 | Finley | 347/85 X |
| 4,994,825 | 2/1991 | Saito et al. . | |
| 5,166,699 | 11/1992 | Yano et al. . | |
| 5,208,604 | 5/1993 | Watanabe et al. . | |
| 5,278,585 | 1/1994 | Karz et al. | 347/65 |
| 5,367,325 | 11/1994 | Yano et al. . | |
| 5,389,957 | 2/1995 | Kimura et al. . | |
| 5,565,899 | 10/1996 | Sugimoto et al. . | |
| 5,625,384 | 4/1997 | Numata et al. . | |
| 5,821,962 | 10/1998 | Kudo | 347/65 |

FOREIGN PATENT DOCUMENTS

| | | | |
|---|---|---|---|
| 0 289 743 | 11/1988 | European Pat. Off. | B41J 3/04 |
| 0 436 047 | 7/1991 | European Pat. Off. | B41J 2/055 |
| 0 561 406 | 9/1993 | European Pat. Off. | B41J 2/165 |
| 55-81172 | 6/1980 | Japan | B41J 3/04 |
| 56-033960 | 4/1981 | Japan | B41J 3/04 |
| 61-69467 | 4/1986 | Japan | B41J 3/04 |
| 62-066941 | 3/1987 | Japan | B41J 3/04 |
| 63-005947 | 1/1988 | Japan | B41J 3/04 |
| 63-199972 | 8/1988 | Japan . | |
| 1-244862 | 9/1989 | Japan | B41J 3/04 |

*Primary Examiner*—John Barlow
*Assistant Examiner*—Charles W. Stewart, Jr.
*Attorney, Agent, or Firm*—Fitzpatrick, Cella, Harper & Scinto

[57] ABSTRACT

A method for preserving a liquid-ejection head is disclosed. The method uses the liquid-ejection head having a first liquid-flowing passage that receives a supply of a first liquid and communicates with an ejection port; a second liquid-flowing passage that receives a supply of a second liquid that differs from the first liquid; a bubble generation area formed on the second liquid-flowing passage for heating the second liquid to generate a bubble in said second liquid; and a movable member positioned between the bubble generation area, having a free end on an ejection port's side of the first liquid-flowing passage and a supporting end on other side of the first liquid-flowing passage, where the free end of the movable member is displaced toward the first liquid-flowing passage by a pressure caused by a generation of the bubble when said second liquid is heated. The method includes a step of performing a replacement of one of the fist liquid and the second liquid with the other at least at a periphery of the ejection port or a periphery of the movable member. Thus the liquid-ejection head is able to perform an excellent recording whether it has not been used for a long time.

34 Claims, 29 Drawing Sheets

METHOD FOR PRESERVING A LIQUID-EJECTION HEAD, AND LIQUID-EJECTION APPARATUS

BACKGROUND OF THE INVENTION

1. Field of the Invention

The present invention relates to a method for preserving a liquid-ejection head that has a movable member to be displaced by an effect of generating a bubble by the action of thermal energy on a liquid, which can be applicable to a printer, a copy machine, a facsimile machine equipped with a communication system, a word processor equipped with a printer component, and so on, and further to an industrial printing apparatus to be provided as an integrated system in combination with various processing devices, for printing an image or the like on a printing medium such as paper, yarn, fiber, cloth, leather, metal, plastic, glass, wood, ceramic or the like. Furthermore, the present invention relates to a liquid-ejection apparatus with means responsible for performing the method described above and with a portion where the liquid-ejection head described above can be installed.

2. Description of the Related Art

Conventionally, so-called bubble-jet printing method has been known as an ink-jet printing method. The method comprises the steps of providing an ink with an energy such as a thermal energy to cause abrupt volume variation (generation of bubble) of the ink, and of ejecting the ink through ejection ports by an acting force on the basis of the state variation to deposit the ejected ink on a printing medium to form an image. In a printing apparatus using the bubble-jet printing method, ejection ports for ejecting the ink, ink passages communicating with the ejection ports, and electrothermal transducers as energy generating means for ejecting ink in the ink passages are typically arranged as disclosed in U.S. Pat. No. 4,723,129 and the like.

With such printing method, high quality image can be printed at high speed and low noise. A printing head implementing this method has many merits that high resolution image and color image can be easily obtained because the ejection ports for ejecting the ink can be arranged at high density. Recently, the bubble-jet printing method has been employed in a large number of office use apparatus, such as printers, copy machines, facsimile machines and the like, and is also applicable to industrial system, such as a textile printing apparatus.

According to spreading of application of the bubble-jet technology in various kinds of products, the following demands are recently growing: for example, optimization of a heater as energy generating means is studied in order to demand for improvement of an energy efficiency. As the optimization of the heater, adjustment of a thickness of a protective layer for standing between the heater and the ink can be nominated. This method is effective for improvement of a transmission efficiency to a generated head to the liquid such as the ink.

On the other hand, in order to obtain high quality image, there has been proposed a driving condition for providing the liquid ejecting method or the like enabling high speed ink ejection and ink injection in good condition based on stable bubble generation. Also, in viewpoint of high speed printing, there has been proposed a printing apparatus with an improved liquid-flowing passage configuration for obtaining the liquid-ejection head having high speed re-fill. Here, "re-fill" means liquid supply from the common liquid chamber to ejection ports through liquid-flowing passages when liquid is ejected from the ejection port to generate negative pressure near the ejection port in the liquid-flowing passage or when bubbles in the liquid shrinks after the pressure generated on growth of the bubbles are utilized for ejection of the liquid.

Among the liquid-flowing passage configuration, the flow passage structure as shown in FIGS. 1A and 1B has been disclosed in Japanese Patent Application Laid-Open No. 199972/1988. The disclosed liquid-flowing passage structure and the head fabrication method are inventions work out in view of a back wave generated associating with generating of the bubble. The back wave is generated by pressure directed toward opposite direction to a direction toward the ejection port, namely a pressure directed to a common liquid chamber 1005. The back wave does not act as an energy in the direction of ink-ejection, so that it is known as a loss energy that reduces an amount of energy for the ink-ejection.

A liquid-ejection head shown in FIGS. 1A and 1B comprises a plurality of heaters 1002 on a single substrate 1001. Each of the heater 1002 is provided as an element for generating an ejection energy for ejecting the liquid. On the substrate 1001, furthermore, a plurality of liquid-flowing passages 1003 are arranged in parallel so as to correspond to their respective heaters 1002. In addition, each of the liquid-flowing passage 1003 is communicated with an individual ejection port 1004, and also communicated with a common liquid chamber designed to supply a liquid into each of them in an amount corresponding to a liquid ejected from the ejection port 1004. As shown in the figures, furthermore, there is a valve 1007 located at a position away from a region, in which the bubble is generated by the heater 1002, and at opposite side to the ejection port 11 with respect to the heater 1002.

In this embodiment, the valve 1007 is prepared as in the form of a plate with one end thereof being fixed on an upper plate provided as a ceiling of the liquid-flowing passage 1003. If the valve 1007 is not subjected to an effect of the bubble generation, a surface of the valve is substantially being attached to a surface of the ceiling. If a bubble 1006 is generated and effects on the valve 1007, as shown in FIG. 1B, a free end of the valve 1007 moves in a curved path and hangs down into the liquid-flowing passage 1003. This invention is disclosed to restrict energy loss by controlling a part of the back wave (i.e., a pressure directed toward the liquid chamber 1005, indicated by the arrow A) by means of the valve 1007.

By the way, the liquid-ejection head shown in FIGS. 1A and 1B is in the type of a set of liquid-flowing passages (also referred as the nozzles) being arranged in parallel as a single-layered structure, in which the heaters 1002 are provided in the respective liquid-flowing passages 1003 communicated with their ejection ports 1004. In this type of the head, however, there is a problem of ejection failure to be caused by clogging the nozzle. When the nozzle is not in use for a long time, a liquid such as ink in the nozzle may be dried and solidified and then solid contents thereof may be attached to an inner wall of the nozzle to cause ejection failure. If the nozzle is clogged up with the solidified ink, it is difficult to remove the clogging material by performing a typical recovery process, such as preparatory ejection or suction recovery to refill a flesh ink into the nozzle.

Conventionally, therefore, the clogging material being firmly fixed to the nozzle's inner wall is forcefully removed by a typical recovery process in combination with an additional process comprised of, for example repeating the cycle of heating and drawing (i.e., the process of forcefully melting the solidified ink), washing with a detergent to remove the fixed material from the nozzle, forcefully destroying the fixed material by an ultrasonically vibration or an ultrasonic cleaning, or the like. However, all of these recovery processes are not appropriate because it is necessary for a man skilled in the art to apply one of the recovery processes after that the solidified ink is firmly attached to the nozzle's surface.

In the liquid-ejection head with the construction as set forth, as can be appreciated from the study for the behavior of a liquid upon the generation of a bubble 1006 in the liquid-flowing passage 1003 that retains the liquid to be ejected, it is not practical to restrict a part of the back wave by means of the valve 1007 for the liquid ejection.

In nature, the back wave per se is not directly associated with the ejection as set forth above. When the back wave is generated within the liquid-flowing passage 1003 as shown in FIG. 1A, a pressure directly associated with ejection of the liquid is already places the liquid from the liquid-flowing passage 1003 in condition permitting ejection thereof. Accordingly, even when a part of the back wave is restricted, no significant effect may be provided for ejection.

On the other hand, in the bubble-jet printing method, since the heater repeats heating in a condition contacting with the ink, a deposit due to baking of the ink is generated on the surface of the heater. In certain kind of the liquid or ink, large amount of deposit is generated to make generation of bubble unstable. Also, when the liquid to be ejected has a property to be easily degraded the quality by heat, or when the liquid is difficult to generate an appropriate bubble, it has been desired to provide a method to achieve good ejection without causing change of property of the liquid to be ejected.

In such viewpoint, a method to use a liquid (bubble-generation liquid) to generate bubble by a heat, which is different from a liquid (ejection liquid) to be ejected, to transmit a pressure generated by growing a bubble to the ejection liquid to perform ejection, has been disclosed in Japanese Patent Application Laid-Open No. 69467/1986, Japanese Patent Application Laid-Open No. 81172/1980, U.S. Pat. No. 4,480,259 and so on. In these publications, an ink as the ejection liquid and the bubble-generation liquid are completely separated by a flexible membrane formed of a silicon rubber or the like so that the ejection liquid may not contact with the heater directly, and pressure generated by growing a bubble in the bubble-generation liquid is transmitted to the ejection liquid by deformation of the flexible diaphragm. By such construction, prevention of deposit on the surface of the heater, improvement of freedom in selection of the ejection liquid and so on can be achieved.

However, in the liquid-ejection head having a construction, in which the ejection liquid and the bubble-generation liquid are separated completely as set forth above, since the pressure generated by growing a bubble in the bubble-generation liquid is transmitted to the ejection liquid by expanding and contracting deformation of the flexible diaphragm, the pressure of the bubble generation can be absorbed by the flexible diaphragm in significant extent. Also, magnitude of deformation of the flexible diaphragm is not so large. Therefore, while it is possible to separate the ejection liquid and the bubble-generation liquid by the flexible diaphragm, there are cases where an energy efficiency and an ejection force of the head are lowered.

The present inventors and their coworkers have been made a close study of improving the fundamental ejection characteristics of the head to an extremely high level which are not expected by the man skilled in the art. The results of their study have been disclosed in the previous application. In this document, the study is performed with three different technical analyses: a first one mainly focused on the mechanism of the movable member in the liquid-flowing passage from the view point of the principle of liquid ejection; a second one mainly focused on the mechanism of ejecting a liquid by an effect of bubble generation; and a third one mainly focused on a bubble-forming area on a heater element for the bubble generation. Consequently, it discloses a new-from-the-ground-up configuration of the head where the bubble generation can be positively controlled if a free end of the movable member is positioned on the nozzle side with respect to a supporting end thereof and a surface of the movable member is positioned so as to face the heater element or the bubble-forming area.

For attaining the improvement on the liquid-ejection efficiency and the liquid-ejection speed, the above document discloses that the positive control of the bubble generation can be attained with the consideration of the amount of energy to be supplied from a growing bubble i.e., with the consideration of the downstream components of the growing bubble. The orientation of the downstream components of the growing bubble should be effectively changed in the direction of liquid ejection. Furthermore, a refill rate can be also improved extensively when the configuration of the liquid-supplying passage and the arrangement of the movable element.

When we focus attention on the condition of storing the liquid-ejection head of the prior document, we find that the liquid-flowing passage can be kept from occurring the adhesion of liquid in advance by forcefully replacing a liquid in the liquid-flowing passage with another type of liquid which is difficult to adhere.

From the viewpoint of the information described above, the liquid-ejection head in the type of using a pair of flow passages requires any good scheme to prepare the recording liquid if the image quality of the recording should be improved. In this configuration, one of those flow passages is for a bubble-forming liquid and the other is for a recording liquid.

Thus, the bubble-forming liquid may be of having a composition appropriate to the bubble formation, while the recording liquid may be of having a composition appropriate to the image-recording. The latter may be, for example, a pigment ink (i.e., an ink for improving the properties of waterproof, concentration, quality of characters, and so on) when the user desires the improvements in a recording concentration and a sharpness of image to be printed on a sheet of ordinary paper. In addition, it is possible to perform a favorable ejection without need to worry about foaming and burning of the recording liquid.

In the case of the head in the type of single-layered nozzles as decried above, a solidified ink can be removed by means of the conventional recovering system when an ink in the nozzle is solidified and attached to an inner wall of the nozzle after reserving the head for the long term. In the case of the head in the type of two-layered nozzles, however, there is no effective recovering system for the recording nozzles being arranged as one layer (recording layer), in which a recording liquid can be easily adhered to an inner wall of each nozzle. For example, there is an idea of removing the adhered material by the application of heat if the adhesion of liquid is occurred in the recording nozzles. In this case, however, the applied heat is conducted into another set of the nozzles being arranged under the recording nozzles through a heat-insulating layer. Thus the adhered ink will be hardly dissolved by the application of heat.

The flow resistance of the blocked upper nozzles is much higher than that of the corresponding lower nozzles. If the conventional recovering system is used for introducing flesh liquid into the upper nozzles, the conventional recovering system will draw in fluid from the lower nozzles by suction instead of drawing in the recording liquid from the upper nozzles being blocked with the adhered material as a result of the difference between their flow resistance. Consequently, the adhered material cannot be removed and the flesh ink cannot be introduced into the upper nozzles.

Accordingly, there is the need for solving the problems of difficulty in recovering the ejection characteristics of nozzles in two-layered nozzle structure by using the conventional recovering system or the application of heat when one of the nozzle layers are blocked, and especially difficulty in re-filling fresh ink into the recording nozzles for the recording liquid appropriate to the recording but not to the long term reservation by removing the adhered material using the conventional recovering system.

SUMMARY OF THE INVENTION

Accordingly, it is an object of the present invention to provide a liquid-ejection apparatus and a method for preserving a liquid-ejection head in the tope of having separated two layers in a single body for supplying a bubble forming liquid and a recording liquid, respectively, to eject the recording liquid smoothly after being left for a long time.

It is a second object of the present invention to provide a method for preventing the adhesion of recording liquid in a head in the tope of having separated two layers in a single body for supplying a bubble forming liquid and a recording liquid.

It is a third object of the present invention to provide a method for reducing the amount of ink consumed by reducing the number of ink-absorbing and draining action in head in the tope of having separated two layers in a single body for supplying a bubble forming liquid and a recording liquid.

It is forth object of the present invention to provide a method for starting the use of a head without any troubles by avoiding the adhesion of recording liquid in a liquid-flowing passage of the head in any cases such as in the distribution channels including a shipment and a sale after the production.

In a first aspect of the present invention, there is provided a method for preserving a liquid-ejection head including:

a first liquid-flowing passage that receives a supply of a first liquid and communicates with an ejection port;

a second liquid-flowing passage that receives a supply of a second liquid that differs from the first liquid;

a bubble generation area formed on the second liquid-flowing passage for heating the second liquid to generate a bubble in the second liquid; and a movable member positioned between the bubble generation area, having a free end on an ejection port's side of the first liquid-flowing passage and a supporting end on other side of the first liquid-flowing passage, where the free end of the movable member is displaced toward the first liquid-flowing passage by a pressure caused by a generation of the bubble when the second liquid is heated, comprising a step of:

performing a replacement of one of the first liquid and the second liquid with other at least at a periphery of the ejection port or a periphery of the movable member.

Here, the replacement may be performed through a portion communicating between the first liquid-flowing passage and the second liquid-flowing passage.

A solidification property of the first liquid may be different from a solidification property of the second liquid, and the replacement may be performed so as to replace a liquid of a comparatively high solidification property with a liquid of a comparatively low solidification property.

A difference between the solidification property of the first liquid and the solidification property of the second liquid may be provided as a difference between a viscosity of the first liquid and a viscosity of the second liquid, and the replacement may be performed so as to replace a liquid of a comparatively high viscosity with a liquid of a comparatively low viscosity.

A difference between the solidification property of the first liquid and the solidification property of the second liquid may be provided as a difference between a water resistant property of the first liquid and a water resistant property of the second liquid, and the replacement may be performed so as to replace a liquid of a comparatively high water resistant property with a liquid of a comparatively low water resistant property.

The replacement may be performed by an application of pressure so as to forcefully supply the first liquid in the first liquid-flowing passage into the second liquid in the second liquid-flowing passage or so as to forcefully supply the second liquid in the second liquid-flowing passage into the first liquid in the first liquid-flowing passage.

The ejection port may be closed prior to the replacement.

The replacement may be performed after issuing an instruction of powering off the liquid ejection head, and the liquid ejection head may be powered off after a completion of the replacement according to the instruction.

The replacement may be performed after a lapse of a predetermined time from a completion of recording.

A heater may be formed on a position facing to the movable member, and the bubble generation area may be provided as a space between the movable member and the heater.

The second liquid-flowing passage may have an inner wall with a substantial flatness or with a gentle slope in its upstream side from the heater, and a liquid supply passage for supplying a liquid onto the heater may be formed along the inner wall.

The free end of the movable member may be positioned on a downstream side from an area center of the heater.

The bubble may be generated by a membrane boiling phenomenon caused in the second liquid in the second liquid-flowing passage by heat generated by a heater.

The movable member may be shaped like a plate.

A whole surface of the heater may face to the movable member.

The free end of the movable member may be at an ejection port side from the heater.

The movable member may be constructed as a part of a separation wall arranged between the first liquid-flowing passage and the second liquid-flowing passage.

The first liquid-flowing passage may be one of a plurality of first liquid-flowing passages that communicate with a first common liquid chamber for supplying a first liquid into each of the first liquid-flowing passages; and the second liquid-flowing passage may be one of a plurality of second liquid-flowing passages that communicate with a second common liquid chamber for supplying a second liquid into each of the first liquid-flowing passages.

In a second aspect of the present invention, there is provided an liquid-ejection apparatus that uses a liquid-ejection head for ejecting a liquid onto a recording medium, where the liquid-ejection head has: a first liquid-flowing passage that receives a supply of a first liquid and communicates with an ejection port; a second liquid-flowing passage that receives a supply of a second liquid that differs from the first liquid; a bubble generation area formed on the second liquid-flowing passage for heating the second liquid to generate a bubble in the second liquid; and a movable member positioned between the bubble generation area, having a free end on an ejection port's side of the first liquid-flowing passage and a supporting end on other side of the first liquid-flowing passage, where the free end of the movable member is displaced toward the first liquid-flowing passage by a pressure caused by a generation of the bubble when the second liquid is heated, comprising:

a replacing means for performing a replacement of one of the fist liquid and the second liquid with other at least at a periphery of the ejection port or a periphery of the movable member.

Here, an apparatus may further comprise:

a detecting means for detecting a condition of the replacement.

The replacing means may be a pressurizing means for closing the ejection port and applying pressure to one of the first liquid and the second liquid.

The second liquid-flowing passage may have a recovery pass on a downstream side of the bubble generation area.

A heater may be formed on a position facing to the movable member, and the bubble generation area may be provided as a space between the movable member and the heater.

The free end of the movable member may be positioned on a downstream side from an area center of the heater.

The second liquid-flowing passage may have an inner wall with a substantial flatness or with a gentle slope in its upstream side from the heater, and a liquid supply passage for supplying a liquid onto the heater may be formed along the inner wall.

The bubble may be generated by a membrane boiling phenomenon caused in the second liquid in the second liquid-flowing passage by heat generated by the heater.

The movable member may be shaped like a plate.

A whole surface of the heater may face to the movable member.

The free end of the movable member may be at an ejection port side from the heater.

The movable member may be constructed as a part of a separation wall arranged between the first liquid-flowing passage and the second liquid-flowing passage.

The first liquid-flowing passage may be one of a plurality of first liquid-flowing passages that communicate with a first common liquid chamber for supplying a first liquid into each of the first liquid-flowing passages; and the second liquid-flowing passage may be one of a plurality of second liquid-flowing passages that communicate with a second common liquid chamber for supplying a second liquid into each of the first liquid-flowing passages.

The first liquid may be ink and the recording medium is a sheet of recording paper, and the liquid-ejection head may eject and deposit the ink on the sheet of recording paper to carry out a recording.

The first liquid may be a printing liquid and the recording medium is a cloth, and the liquid-ejection head may eject and deposit the printing liquid on the cloth to carry out a printing.

In a third aspect of the present invention, there is provided a recording system having a liquid-ejection apparatus and a post-treatment apparatus for stimulating a fixation of the liquid on the recording medium, where the liquid-ejection apparatus uses a liquid-ejection head that includes: a first liquid-flowing passage that receives a supply of a first liquid and communicates with an ejection port; a second liquid-flowing passage that receives a supply of a second liquid that differs from the first liquid; a bubble generation area formed on the second liquid-flowing passage for heating the second liquid to generate a bubble in the second liquid; and a movable member positioned between the bubble generation area, having a free end on an ejection port's side of the first liquid-flowing passage and a supporting end on other side of the first liquid-flowing passage, where the free end of the movable member is displaced toward the first liquid-flowing passage by a pressure caused by a generation of the bubble when the second liquid is heated, comprising:

a replacing means for performing a replacement of one of the fist liquid and the second liquid with other at least at a periphery of the ejection port or a periphery of the movable member.

In a fourth aspect of the present invention, there is provided a recording system having a liquid-ejection apparatus and a pre-treatment apparatus for stimulating a fixation of the liquid on the recording medium, where the liquid-ejection apparatus uses a liquid-ejection head that includes: a first liquid-flowing passage that receives a supply of a first liquid and communicates with an ejection port; a second liquid-flowing passage that receives a supply of a second liquid that differs from the first liquid; a bubble generation area formed on the second liquid-flowing passage for heating the second liquid to generate a bubble in the second liquid; and a movable member positioned between the bubble generation area, having a free end on an ejection port's side of the first liquid-flowing passage and a supporting end on other side of the first liquid-flowing passage, where the free end of the movable member is displaced toward the first liquid-flowing passage by a pressure caused by a generation of the bubble when the second liquid is heated, comprising:

a replacing means for performing a replacement of one of the fist liquid and the second liquid with other at least at a periphery of the ejection port or a periphery of the movable member.

The above and other objects, effects, features and advantages of the present invention will become more apparent from the following description of embodiments thereof taken in conjucntion with the accompanying drawings.

DETAILED DESCRIPTION

Figure 1A:
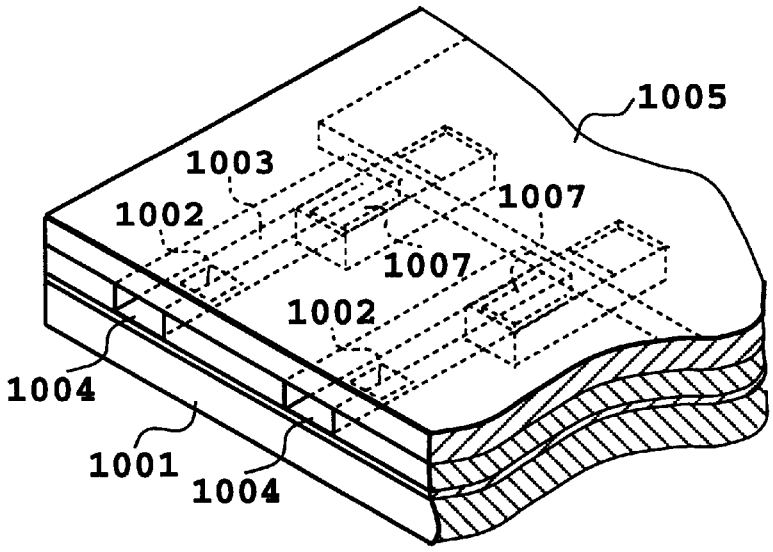
FIG.1A PRIOR ART
FIG. 1A is a perspective view that shows a structure of a liquid-flowing passage of the liquid-ejection head.
Figure 1B:
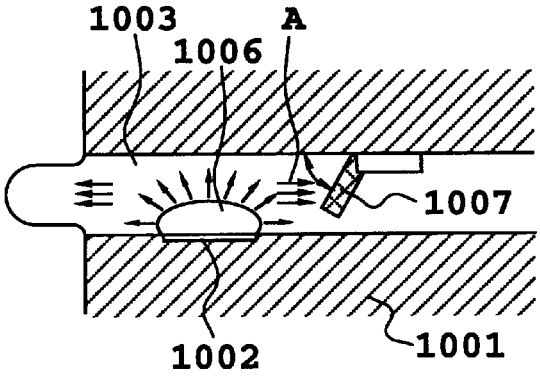
FIG.1B PRIOR ART
FIG. 1B is a cross sectional view that shows the same structure as that of FIG. 1A.

Hereinafter, preferred embodiments of present invention will be explained in detail with reference to the drawings.

It should be noted that, in the present invention, a term "a recording medium" means paper, yarn, fiber, cloth, leather, metal, plastic, glass, wood, ceramic or the like, and also a word "print" not only means forming a meaningful image per se, such as character, drawing and the like, but also means forming a meaningless image, such as a pattern.

In addition, a term "a recording apparatus" or "a liquid-ejection apparatus" means a printer, a copy machine, a facsimile machine equipped with a communication system, a word processor equipped with a printer component, and so on, and further to an industrial printing apparatus to be provided as an integrated system in combination with various processing devices, for printing an image or the like on a printing medium.

It should be further noted that, in the description of the present invention, "upstream" and "downstream" is related to a flow direction of the liquid directed from a supply source of the liquid to the ejection port via a bubble-generating area (or the movable member) or an expression with respect to a direction in construction.

On the other hand, "downstream side" with respect to the bubble per se represents ejection port side portion of the bubble considered to directly act for the ejection of the liquid droplet. More particularly, with respect to the center of the bubble, it means the downstream side relative to the flow direction or the direction in construction, or the bubble generated in the region of the downstream side with respect to the center of the area of the heater.

The passage "substantially enclosed" used in description of the present invention means the condition that when the bubble grows, the bubble may not pass through a gap (slit) around the movable member before displacement of the movable member.

Furthermore, "separation wall" in the present invention means a wall (may include the movable member) disposed for separating the bubble generation area and the region directly communicated with the ejection port, in broad sense, and means the member which separates the liquid-flowing passage including the bubble generation area and the liquid-flowing passage directly communicated with the ejection port for admixing of the liquids in respective regions.

In the present invention, "solidification characteristics" means the properties of being able to coagulate or adhere dissolved molecules or particles together in a fluid or in the condition where they come into contact with the air. In addition, "a region" as an object of the substitution is a portion with consideration given to the solidification characteristics to be affected to the head. The considerable minimum part of the region is the margins of the movable member and/or the portion close to the ejection orifice. In the present invention, therefore, the substitution is occurred at that portion.

First of all, the operating principles of a liquid-ejection head will be described in detail with reference to the drawings. For ejecting a liquid, the following description is provided as an example for improving an ejection force, an ejection efficiency, and the like by controlling the direction of growing a bubble and the traveling direction of a pressure wave caused by the bubble formation through the liquid. In the following description, for concrete clarification without great difficulty, we assume that the liquid-ejection head comprises a first liquid-flowing passage and a second liquid-flowing passage, both of them receive the same kind of liquid.

Figure 2A:
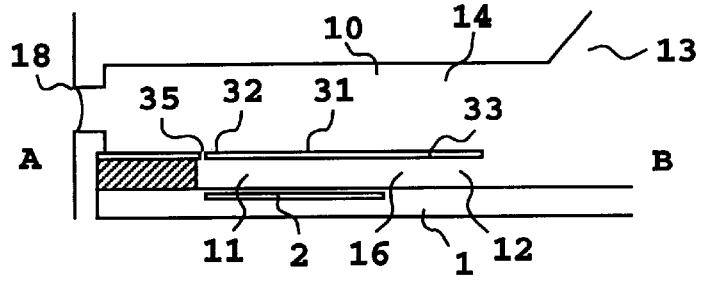
FIGS. 2A–2D are schematic cross sectional views that illustrate the liquid flow direction of a liquid-ejection head as one of the preferred embodiments of the present invention.
Figure 2B:
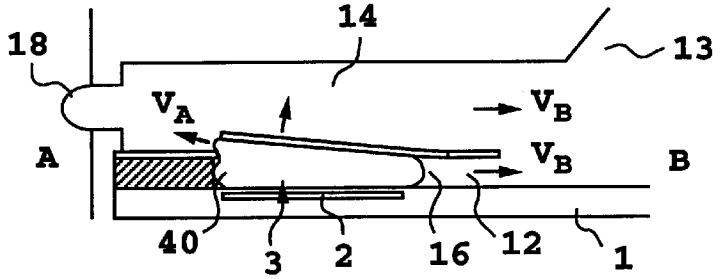
Figure 2C:
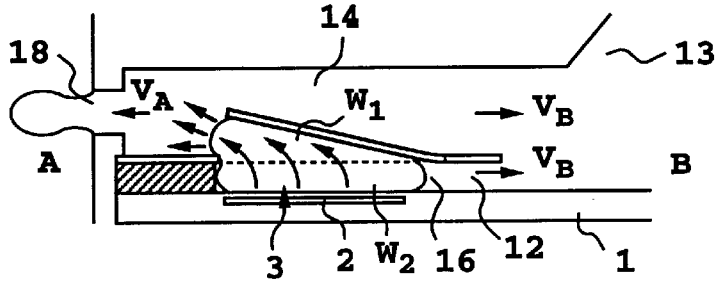
Figure 2D:
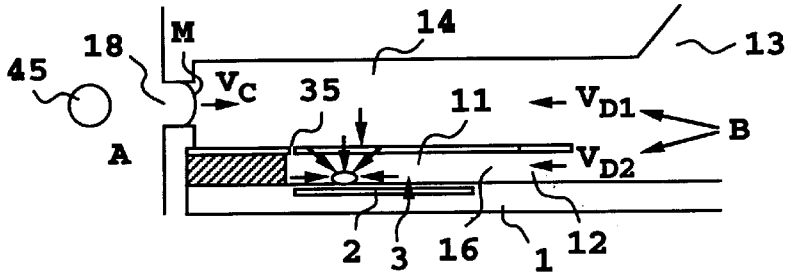
Figure 3:
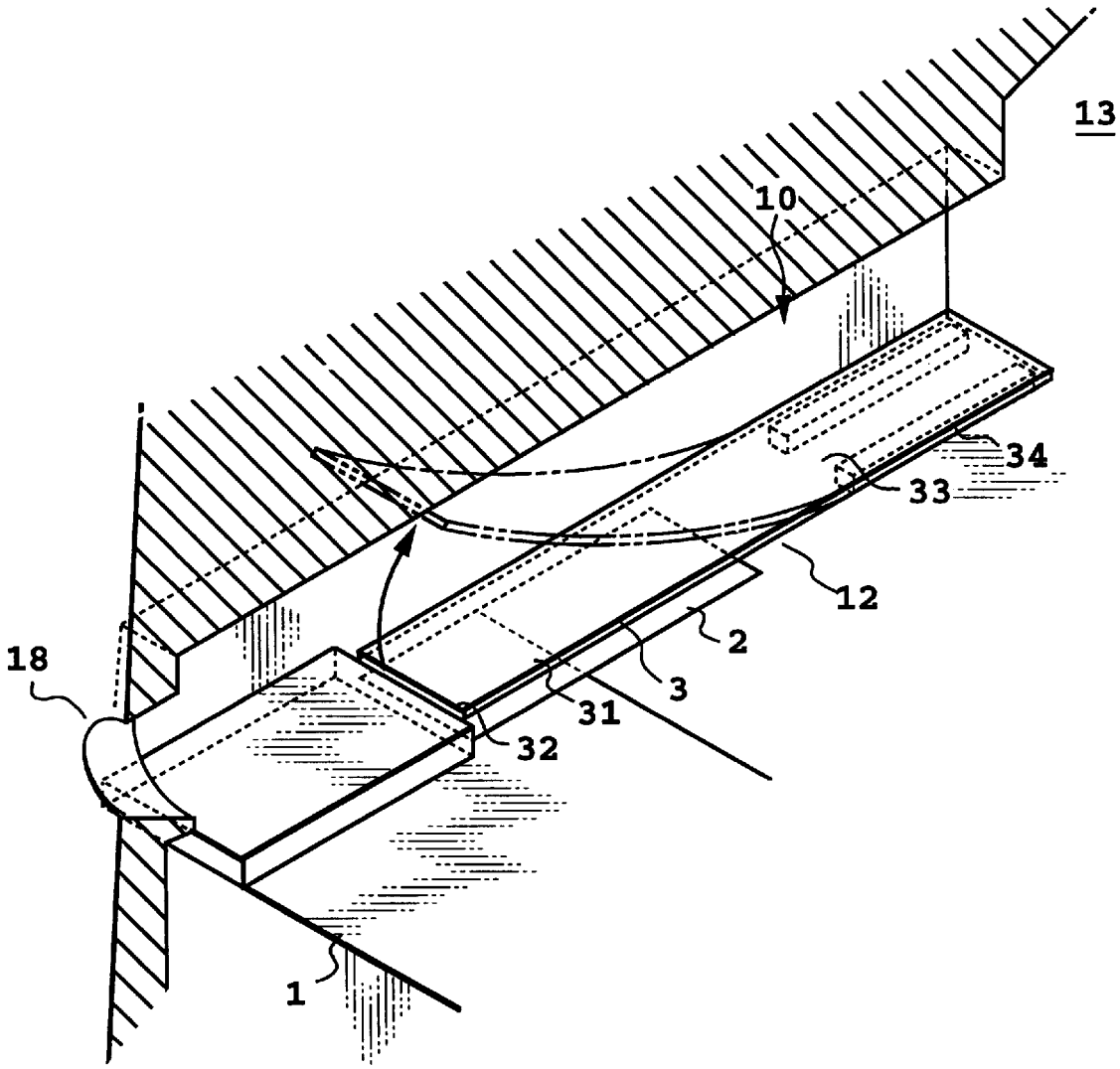
FIG. 3 is a perpsective view that shows a liquid-ejection head as one of the preferred embodiments of the present invention.

FIGS. 2A to 2D are sectional diagrams that illustrate the liquid flow direction of a liquid-ejection head of the present embodiment, and FIG. 3 is a partially cut-out perspective view of the liquid-ejection head.

The liquid-ejection head showing the figures has liquid-flowing passage 10 consisting of a first liquid-flowing passage 14 for ejecting an ejection liquid and a second liquid-flowing passage 16 for keeping a bubble-generation liquid to be bubbled. In this case, the bubble-generation liquid and the ejection liquid are the same, so that those passages 14, 16 are communicated with a single common liquid chamber 13. As shown in the figure, the first liquid-flowing passage 14 is responsible for ejecting a liquid in direct communication with an ejection port 18 and is arranged in parallel over a second liquid-flowing passage 16 on a substrate 1. In the head, furthermore, a heater element 2 is formed on the substrate 1 for providing thermal energy for generating a bubble in the second liquid-flowing passage 16. In this embodiment, a heater element 2 is in the shape of a rectangle with a size of 40 $\mu$m×105 $\mu$m.

The upstream side of the liquid-flowing passage is communicated with the common liquid chamber 13. The chamber 13 is responsible for supplying an appropriate amount of liquid so as to correspond to the volume of an ejected droplet of the liquid to a plurality of the first liquid-flowing passages 10.

As shown in the figures, there is a separation wall 35 between the first liquid-flowing passage 14 and the second liquid-flowing passage 16. In addition, a movable member 31 is constructed as a part of the separation wall 35 and is shaped like a plate facing to the heater 2, in cantilever fashion. The movable member 31 is made of a material having elasticity, such as a metal or the like and has a flat surface portion. One end of the movable member is fixed to the separation wall (i.e., the support member) 34 formed by patterning of a photosensitive resin on the wall of the liquid-flowing passage 10 or the substrate. By this, the movable member is held and a fulcrum (fulcrum portion) 22 is constructed.

The movable member 31 is arranged in such a manner that it has a fulcrum (fulcrum portion: fixed end) 33 at the upstream side of a flow flowing from the common liquid chamber 13 to the ejection port 18 via the movable member 31, and a free end (free end portion) 32 at the downstream side with respect to the fulcrum 33, and that it is located at a position opposing to the heater 2 in a condition covering the heater 2 with a distance about 15 mm from the heater 2. A gap between the heater and movable member becomes a bubble generation area 11. It should be noted that kind, shape and arrangement of the movable member are not limited to the shown kind, shape and arrangement, and can be of any shape and arrangement which can control growth of bubble and transmission of pressure as will be discussed later. It should be noted that the foregoing liquid-flowing passage 10 will be explained separately dividing into a portion directly communicated with the ejection port 18 as a first liquid-flowing passage 14, and a portion having the bubble generation area 11 and the liquid supply passage 12 as a second liquid-flowing passage 16, across the movable member 31, for explaining flow of the liquid to be explained later.

By applying heat for the liquid of the bubble generation area 11 between the movable member 31 and the heater 2 by the heater 2, a bubble is generated in the liquid by film boiling as disclosed in U.S. Pat. No. 4,723,129. The pressure by generation of bubble and bubble per se are preferentially act on the movable member, and then, the movable member 31 is displaced to toward the ejection port to open widely about the fulcrum 33 as shown in FIGS. 2A and 2B, or FIG. 2. By displacement or displaced condition of the movable member 31, transmission of the pressure generated by bubble generation and growth of the bubble are directed toward the ejection port.

Here, the basic principle of ejection regarding the present invention will be explained. In the present invention, one of the most important principle is that by the movable member arranged opposing bubble is displaced from the first position in the steady state to the second position after displacement by the pressure of the bubble or the bubble per se, to feed the pressure associating with generation of bubble or the bubble per se toward the downstream side where the ejection port 18 is arranged, by displacement of the movable member 31.

Figure 4:
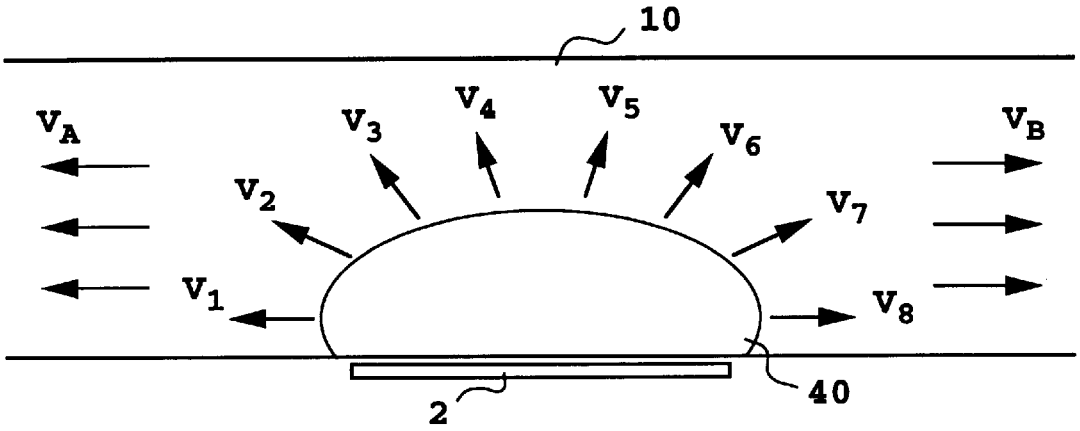
FIG.4 PRIOR ART
FIG. 4 is a schematic diagram that illustrates a propagation of pressure applied by the generation of a bubble in the conventional liquid-ejection head.
Figure 5:
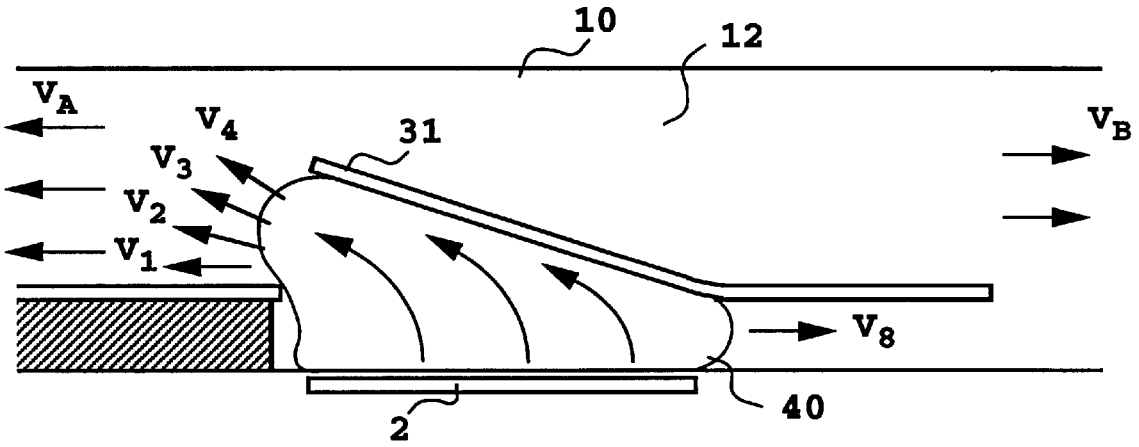
FIG. 5 is a schematic diagram that illustrates a propagation of pressure applied by the generation of a bubble in the liquid-ejection head in accordance with the present invention.

This principle will be further explained with comparing FIG. 4 diagrammatically showing the conventional liquid-flowing passage structure without using the movable member and FIG. 5 diagrammatically showing the liquid-flowing passage structure using the movable member according to the present invention. It should be noted that here, a transmitting direction of the pressure toward the ejection port is VA and the transmitting direction of the pressure toward the upstream side.

In the conventional head shown in FIG. 4, there is no construction to restrict transmitting direction of the pressure generated by the generated bubble 40. Therefore, pressure transmitting direction of the bubble 40 becomes perpendicular line directions of the surface of bubble as shown by arrows V1 to V8 and thus is directed in various directions. Amongst, one having a component having largest influence in liquid ejection and having pressure transmitting direction in VA direction, is the direction component of the pressure transmission at the portion of the ejection port side with respect to the substantially half position of the bubble. This portion is important portion directly contributing for liquid ejection efficiency, liquid ejection force, ejection speed and so on. Furthermore, V1 is closest to the direction of ejection VA, and thus act efficiently. Conversely, V4 has relatively small component directed toward VA.

In contrast to this, in case of the present invention as illustrated in FIG. 5, the movable member 31 directs the transmitting direction of the pressure in various direction in the conventional head as illustrated in FIG. 4 to the direction of V1 to V4 to lead the pressure toward the downstream side to convert into the pressure transmitting direction of VA. By this, the pressure of the bubble 40 can directly and efficiently contribute for ejection. Furthermore, since the growth direction of the bubble per se is also led toward the downstream side similarly to the pressure transmitting direction V1 to V4 to grow to be greater at the downstream side than the upstream side. As set forth, by controlling the growth direction per se of the bubble and transmitting direction of the pressure of the bubble, ultimate improvement of the ejection efficiency, ejection force, ejection speed and so on can be achieved.

Next, returning to FIGS. 2A to 2D, the ejecting operation of the present embodiment of the liquid-ejection head will be described in detail.

FIG. 2A shows a condition before application of an energy, such as an electrical energy or the like to the heater 2 and thus shows the condition before the heater generates heat. The important thing at this condition is that the movable member 31 is provided at a position at least opposing to the downstream side portion of the bubble in relation to the bubble to be generated by the heater. Namely, so that the downstream side portion of the bubble may act on the movable member, the movable member 31 is arranged at least to the downstream position (downstream of a line extending through the center 3 of the area of the heater in a direction perpendicular to the longitudinal direction of the liquid-flowing passage) of the center 3 of the area of the heater in the liquid-flowing passage structure.

FIG. 2B shows a condition, in which the electrical energy or the like is applied to the heater 2, the heater 2 is thus heated, a part of the liquid filling the bubble generation area 11 is headed by the generated heat, and thus bubble is generated by film boiling.

At this time, the movable member 31 is displaced from the first position to the second position by the pressure generated by generation of bubble 40 so that the transmitting direction of the pressure of the bubble 40 may be directed toward the ejection port. The important matter herein is that the movable member 31 is arranged to place the free end 32 of the movable member 31 at the downstream side (ejection port side) and to place the fulcrum 33 at the upstream side (common liquid chamber side) to make at least a part of the movable member to opposite the downstream side portion of the heater, i.e., the downstream side portion of the bubble.

FIG. 2C shows the case where the bubble 40 is further grown. According to increasing of pressure due to generation of the bubble, the movable member 31 is further displaced. The generated bubble grows to be greater at the downstream side than that in the upstream position, and in conjunction therewith, the bubble is grown to be greater beyond the first position (position shown by broken line). Thus, by gradually displacing the movable member 31 according to growth of the bubble, the ejection efficiency of the head can be elevated by uniformly directing the transmitting direction of the pressure of the bubble 40 and the direction of easily shifting of volume, namely the grown direction toward the free end 32 of the movable member 31, toward the ejection port. This also contribute for enhancing the ejection efficiency. Upon guiding the bubble, the bubble pressure toward the ejection port, the movable member will never cause interference, and can control transmitting direction of the pressure or the growth direction of bubble depending upon magnitude of the pressure to be transmitted.

FIG. 2D shows a condition where the internal pressure of the bubble 40 is lowered to cause shrinking of the bubble 40 to extinct, after film boiling.

The movable member 31 displaced to the second position then returns to the initial position (first position) of FIG. 2A by vacuum pressure due to shrinking of the bubble and by resistive force due to the elasticity of the movable member 31 per se. On the other hand, during shrinking of bubble to extinct, in order to compensate the shrinking volume and thus to compensate the ejected amount of the liquid, the liquid flows from the upstream side, i.e. the common liquid chamber side as flows VD1 and VD2 and from the ejection port side as flow Vc.

While the operation of the movable member and liquid ejecting operation associating with generation of bubble have been explained, re-filling of liquid in the liquid-ejection head according to the invention will be described in greater detail.

A liquid supply mechanism in the present invention will be described in greater detail with reference to FIGS. 2A to 2D.

After FIG. 2C, when the bubble 40 enters into extinction stage after the state of the maximum volume, the liquid in the volume compensating the extinction volume of the bubble flows into the bubble generation area from the ejection port 18 side of the first liquid-flowing passage 14 and from the common liquid chamber 13 side of the second liquid-flowing passage 16. In the conventional liquid-flowing passage structure having no movable member 31, the amount of liquid flowing into the bubble extinction position from the ejection port side and the amount of liquid from the common liquid chamber depend on flow resistance at the portion located at the ejection port side with respect to the bubble generation area and the portion located at the common liquid chamber side with respect to the bubble generation area (depending upon flow resistance of the passage and the inertia of the liquid).

Therefore, when the flow resistance at a portion near the ejection port is smaller, greater amount of liquid flows into the bubble extinction position to increase retracting magnitude of the meniscus. Particularly, when the flow resistance at the portion near the ejection port is made smaller for enhancing ejection efficiency, retraction magnitude of the meniscus upon extinction of bubble becomes greater to take longer re-fill period to obstruct high speed printing.

In contrast to this, since the present embodiment is provided the movable member 31, assuming that the volume of bubble W is W1 at upper side and W2 at the bubble generation area 11 side across the first position of the movable member 31, retraction of meniscus is stopped at a timing where the movable member returned to the initial (first) position, and remaining volume of W2 is mainly supplied by the flow VD2 of the second liquid-flowing passage 16. By this, the retraction amount of meniscus which corresponds to approximately half of the volume W of the bubble in the prior art, can be retracted to be about half of W1 which is smaller than half of W.

Furthermore, liquid supply for the column of W2 is performed along the heater side surface of the movable member 31 utilizing the negative pressure upon extinction of bubble, forcefully mainly from the upstream side (VD2) of the second liquid-flowing passage, quicker re-fill can be achieved.

The feature is that, if the re-filling utilizing the pressure upon extinction of bubble in the conventional head, vibration of meniscus becomes large to cause degradation of printed image quality, whereas, in the high speed re-fill in the present embodiment, liquid communication between the first liquid-flowing passage at the ejection port side and the bubble generation area is restricted by the movable member, vibration of the meniscus can be restricted to be quite small.

As set forth, according to the present invention, by forced re-fill into the bubble generation area via the liquid supply passage of the second liquid-flowing passage 16 and high speed re-fill with restricting retraction and vibration of meniscus, stability of ejection, high speed repeated ejection can be achieved. Furthermore, when the present invention is applied for image printing, improvement of printed image quality and high speed printing can be realized.

In the present invention, the following effective function can be achieved: Transmission of the pressure generated by the bubble toward the upstream side (back wave) can be restricted. Among bubbles generated on the heater 2, the most pressure generated by the bubble within the common liquid chamber 13 side (upstream side) serves as a force to push back the liquid toward the upstream side (back wave). This back wave caused increasing of pressure at the upstream side, the liquid movement, and inertia force due to motion of the liquid to lower performance of re-filling the liquid-flowing passage to obstruct high speed driving. In the present invention, these effects toward the upstream side can be restricted by the movable member 31 to improve re-fill performance.

Next, further particular structure and effect to be achieved by the present embodiment will be explained.

The second liquid-flowing passage 16 of the present embodiment has a liquid supply passage 12 having internal wall jointed with the heater in substantially flush surface. In such case, supply of the liquid to the bubble generation area 11 and the surface of the heater 2 is performed along the surface at closer side to the bubble generation area 11 of the movable member 31. Therefore, stagnation of the liquid on the surface of the heater 2 can be prevented to promote separating out of the gas dissolved in the liquid and removal of residual bubble remained without extinction. Furthermore, excessive accumulation of the heat can also be prevented. Accordingly, stable bubble generation can be repeated at high speed. It should be noted that while the present embodiment has been described in terms of the head having the liquid supply passage 12 with substantially flat inner wall, it is only required to be smoothly jointed with the surface of the heater and to have smooth inner wall in the liquid supply passage so as not to cause stagnation of the liquid on the heater and significant disturbance in supply of the liquid.

Also, supply of the liquid to the bubble generation area is also performed from VD1 through the side portion (slit 35) of the movable member. However, in case that, in order to guide the pressure upon generation of bubble more effectively to the ejection port, a large movable member to cover entire bubble generation area (covering the heater surface) as shown in FIG. 2, and the flow resistance of the liquid in the bubble generation area 11, the region of the first liquid-flowing passage in the vicinity of the ejection port are increased by returning the movable member 31 to the first position, the liquid flow from VD1 to the bubble generation area 11 is blocked. However, in the head structure according to the present invention, because of presence of flow VD1 for supplying the liquid to the bubble generating portion, liquid supply performance becomes quite high so as not to cause lowering of the liquid supply performance even with the construction seeking for improvement of ejection efficiency, such as the movable member 31 entirely covering the bubble generation area 11.

Figure 6:
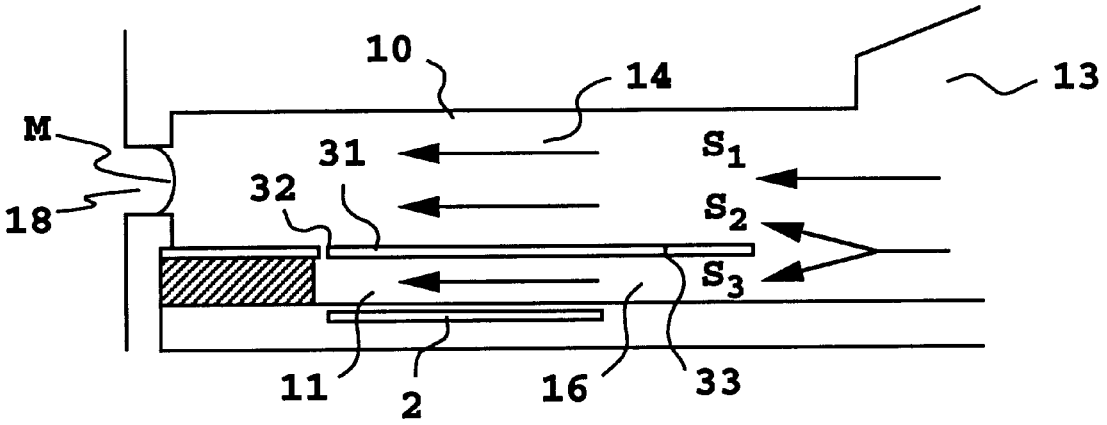
FIG. 6 is a schematic diagram that illustrates a flow of liquid in the liquid-ejection head in accordance with the present invention.

On the other hand, the positional relationship of the free end 32 of the movable member 31 and the fulcrum 33 is that the free end 32 is located at downstream side relative to the fulcrum 33. For such construction, the function and effect to direct the transmission direction of the bubble and the growth direction of the bubble toward the ejection port side upon generation of bubble as set forth above can be efficiently realized. Furthermore, this positional relationship achieves not only the function and effect for ejection as set forth above but also the effect to permit high speed re-fill with reduced flow resistance for the liquid flowing through the liquid-flowing passage 10 during supplying of the liquid. As shown in FIG. 6, this is because when the meniscus retracted by ejection is returned to the ejection port 18 by capillary effect, or when the liquid is supplied in response to extinction of bubble, the free end of the fulcrum 33 are arranged so as not to resist against the flows S1, S2 and S3 flowing in the liquid-flowing passage 10 (including first liquid-flowing passage 14 and the second liquid-flowing passage 16).

Additionally, in the present embodiment of FIG. 3, the free end 32 of the foregoing movable member 31 is extended with respect to the heater 2 so as to be placed at the downstream side position than the center 3 of the area (line extending across the center of the area of the heater in perpendicular to the longitudinal direction of the liquid-flowing passage) dividing the heater into the upstream side region and the downstream side region. By this, the pressure or bubble significantly contribute for ejection of the liquid generated at the downstream side of the center position of the area of the heater is received by the movable member 31 to guide the pressure and bubble toward the ejection port side to significantly improve the ejection efficiency and ejection force.

Furthermore, in addition, many effects are achieved by utilizing the upstream side of the bubble.

On the other hand, in the construction of the present embodiment, momentary mechanical displacement of the free end of the movable member 31 also effectively contributes for ejection of the liquid.

<Embodiment 1>

Hereinafter, a method for preserving a liquid-ejection head as a first embodiment of the present invention will be explained with reference to the drawings.

Even in the present embodiment, primary principle of ejection of the liquid is the same as the operation principle described above. However, in the present embodiment, with a multiple-passage construction of the liquid-flowing passage, and the liquid (bubble-generation liquid) to be bubbled by application of the heat, and the liquid (ejection liquid) to be mainly ejected can be separated.

Figure 7:
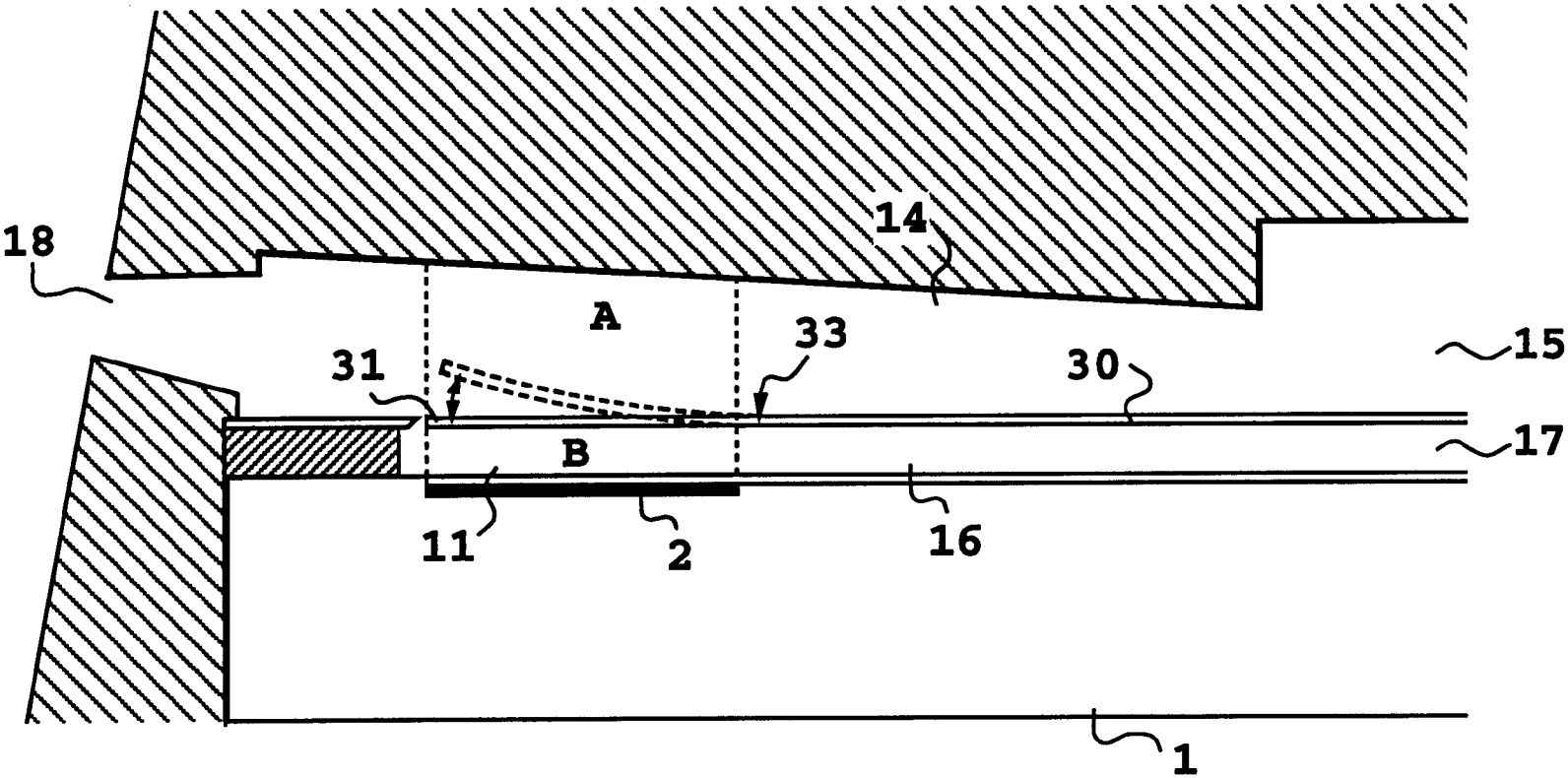
FIG. 7 is a cross sectional view that shows a liquid-ejection head in the type of having two passages as one of the preferred embodiment of the present invention.
Figure 8:
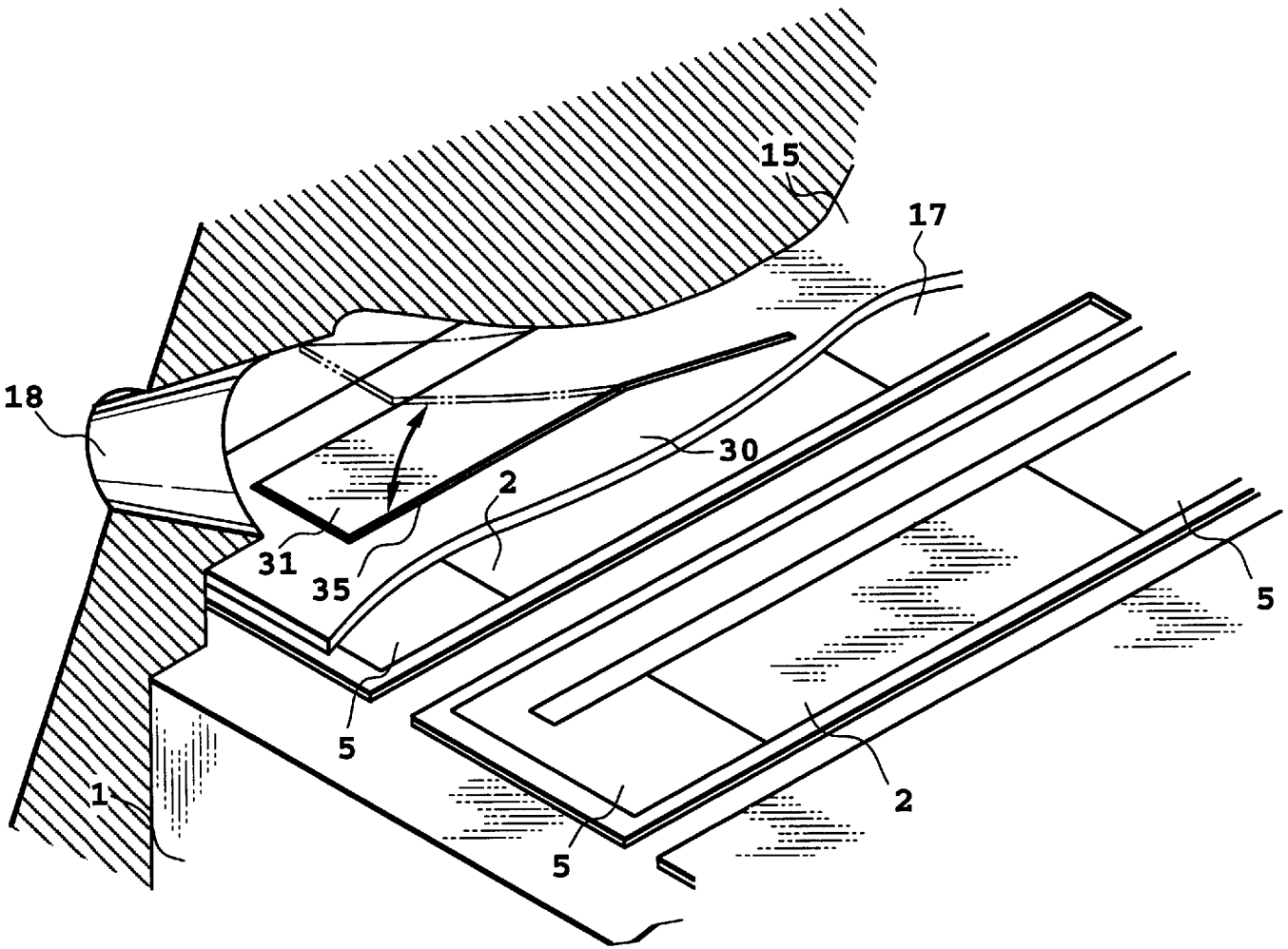
FIG. 8 is a partially cross sectional perspective view that shows a liquid-ejection head as one of the preferred embodiments of the present invention.

FIG. 7 is a sectional diagram of the liquid flow direction of the liquid-ejection head of the present embodiment, and FIG. 8 is a partially cut-out perspective view of the liquid-ejection head.

The present embodiment of the liquid-ejection head is constructed with the second liquid-flowing passage for the bubble generation is arranged on the substrate 1, in which the heater 2 for providing thermal energy for generating bubble in the liquid, the first liquid-flowing passage for ejection in direct communication with the ejection port is arranged over the second liquid-flowing passage.

The upstream side of the first liquid-flowing passage is communicated with the first common liquid chamber for supply the ejection liquid to a plurality of the first liquid-flowing passage, and the side of the second liquid-flowing passage at the upstream, is communicated with a second common liquid chamber.

It should be appreciated that when the bubble-generation liquid and the ejection liquid are the same, it is possible to unite the common liquid chambers to be a single common liquid chamber as shown in FIGS. 2A–2D and FIG. 3.

Between the first and second liquid-flowing passages, a separation wall 35 formed of a material having elasticity, such as metal to separate them. It should be noted that when the bubble-generation liquid and the ejection liquid are the liquids to be not admixed as much as possible, it should be better to separate the liquids in the first and second liquid flow chambers 14 and 16 as much as possible. When no problem will be arisen even if the bubble-generation liquid and the ejection liquid are admixed, it may not be necessary to provide a configuration for complete separation.

The portion of the separation wall 35 located in a space above the heater, to which the surface of the heater may be projected (hereinafter referred to as ejection pressure generating region, the region including both region A and the bubble generation area 11 designated by symbol B in FIG. 7), is the movable member 31 in cantilever configuration, which has the free end on the ejection port side (downstream side of the flow of the liquid) and the fulcrum 33 on the side of common liquid chambers 15,17. Since the movable member 31 is arranged in opposition to the bubble generation area 11 or B, it opens toward the ejection port side of the first liquid-flowing passage (in the direction of arrow in the drawing) in response to the bubble generation in the bubble-generation liquid. Even in FIG. 8, on the substrate 1, on which the heating resistor portion as the heater 2 and the wiring electrode 5 for applying the electric signal to the heating resistor portion, the separation wall 30 is arranged via a space defining the second liquid-flowing passage.

The relationship between arrangement of the fulcrum 33 and the free end 32 of the movable member 31 and arrangement of the heater is the same as the former embodiment.

On the other hand, while the relationship of the liquid supply passage 12 and the heater in construction has been explained with respect to the former embodiment, even in the present embodiment, the relationship of constriction of the first liquid-flowing passage 16 and the heater 2 is the same.

Next, the operation of the present embodiment of the liquid-ejection head will be explained with reference to FIGS. 9A and 9B.

Upon driving of the head, as the ejection liquid to be supplied to the liquid-flowing passage 12 and the bubble-generation liquid supplied to the second liquid-flowing passage 16, the same water base ink is employed for operation.

The heat generated by the heater 2 acts on the bubble-generation liquid within the bubble generation area of the second liquid-flowing passage, bubble 40 is generated in the bubble-generation ink through film boiling as disclosed in U.S. Pat. No. 4,723,129, similarly to that illustrated in, for example FIGS. 2A–2D.

In the present embodiment, the bubble generation pressure may never escape through three directions except for the upstream side of the bubble generation area. Therefore, the pressure associated with generation of the bubble is concentrically transmitted on the side of the movable member 31 arranged in the ejection pressure generating portion to cause displacement of the movable member 31 from the condition of FIG. 9A toward the first liquid-flowing passage side as shown in FIG. 9B. By this action of the movable member 31, the first and second liquid-flowing passages 14 and 16 are communicated with wide path area so that the pressure generated by the bubble generation is mainly transmitted in the direction toward the ejection port (direction A) of the first liquid-flowing passage. By this pressure transmission and mechanical displacement of the movable member as set forth above, the liquid is ejected through the ejection port.

Figure 9A:
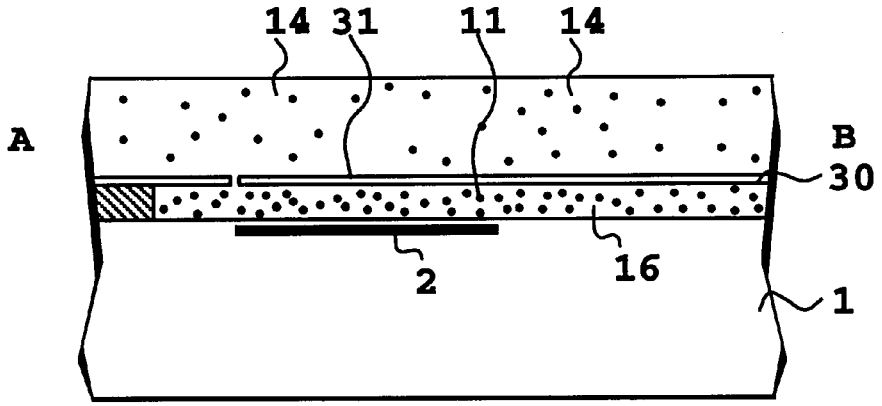
FIG. 9A is a cross sectional view that illustrates the motion of a movable member in a liquid-flowing passage, where the movable member is closed.
Figure 9B:
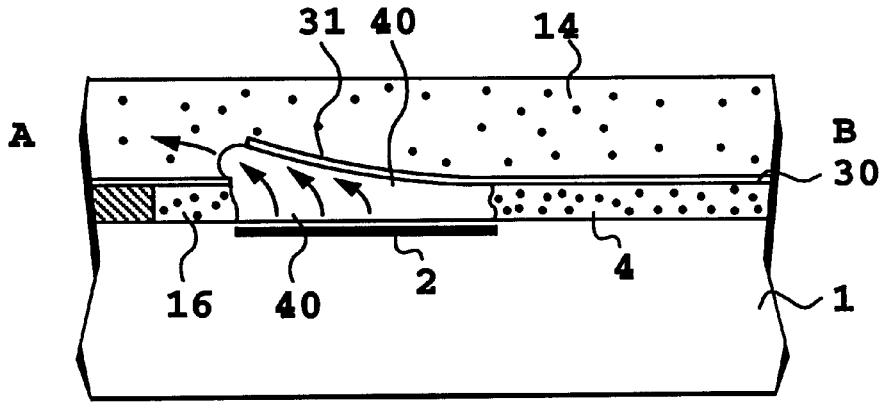
FIG. 9B is a cross sectional view that illustrates the motion of a movable member in a liquid-flowing passage, where the movable member is opened.

Next, according to shrinking of the bubble, the movable member 31 returned to the position of FIG. 9A. In conjunction therewith, the ejection liquid in amount corresponding to the amount of the ejected liquid is supplied from the upstream side in the first liquid-flowing passage 14. Even in the present embodiment, supply of the ejection liquid is performed in the direction of closing the movable member similarly to the former embodiment, re-fill of the ejection liquid may not be obstructed by the movable member.

While the present embodiment is the same as that illustrated in FIGS. 2A–2D and FIGS. 3–6 and so on in terms of operation and effect of the major part with respect to transmission of the bubble generation pressure by displacement of the movable member, growth direction of the bubble, prevention of back wave and the like, following further advantages can be achieved with the two flow passage construction as in the present embodiment.

Namely, with the construction of the foregoing embodiment, the ejection liquid and the bubble-generation liquid can be mutually different liquid so that the ejection liquid may be ejected by the pressure generated by growing a bubble in the bubble-generation liquid. Therefore, even with high viscous liquid, such as polyethylene glycol or the like which is difficult to generate sufficient bubble and can generate insufficient ejection force in the prior art, it becomes possible to obtain satisfactory ejection by supplying the liquid having good the bubble generation characteristics (a mixture of ethanol: water=4:6 about 1 to 2 cpc or the like) or a liquid having low boiling point to the second liquid-flowing passage.

On the other hand, by selecting a liquid which does not cause deposit, such as torrid or the like on the surface of the heater even in subjecting a heat, as the bubble-generation liquid, the bubble generation becomes stable to obtain satisfactory ejection.

Furthermore, in the head structure according to the present invention as set forth above, the effect explained in the former description can be achieved. Thus, the liquid such as the high viscous liquid or the like can be ejected with high ejection efficiency and high ejection force.

On the other hand, even in the case of the liquid weak in the heat, high efficiency and high ejection force of such liquid can be done by supplying such liquid to the first liquid-flowing passage as the ejection liquid, and by supplying a liquid which is difficult to cause alternation of property due to heat and can easily generate bubble, to the second liquid-flowing passage, without causing adverse effect.

The liquid-ejection head described above uses two different liquids, the ejection liquid (the first liquid) and the bubble-generation liquid (the second liquid). There are various types of liquid to be applied as the first or second liquid. Some of them have a solids constituent which tends to adhere to an inner wall of the liquid-flowing passage when the liquid-ejection head has not been used for a long time (i.e., it has been preserved for the long term). Therefore, the present invention provides the way of avoiding such undesired phenomenon through the use of the difference in their conservation features under the condition of the long term preservation, preventing the liquid from being changed. For that purpose, we have been conducted a detailed analysis of the physical characteristics of each liquid, such as viscosity, boiling point, water resistance, and surface tension, As a consequence, we find that the ejection characteristic of the liquid-ejection head will be easily recovered in spite of after the long term preservation if a liquid in one passage is replaced with the other which is comparatively difficult to adhere to the passage's inner wall and is comparatively easy to recover from the condition of being adhered.

Figure 10:
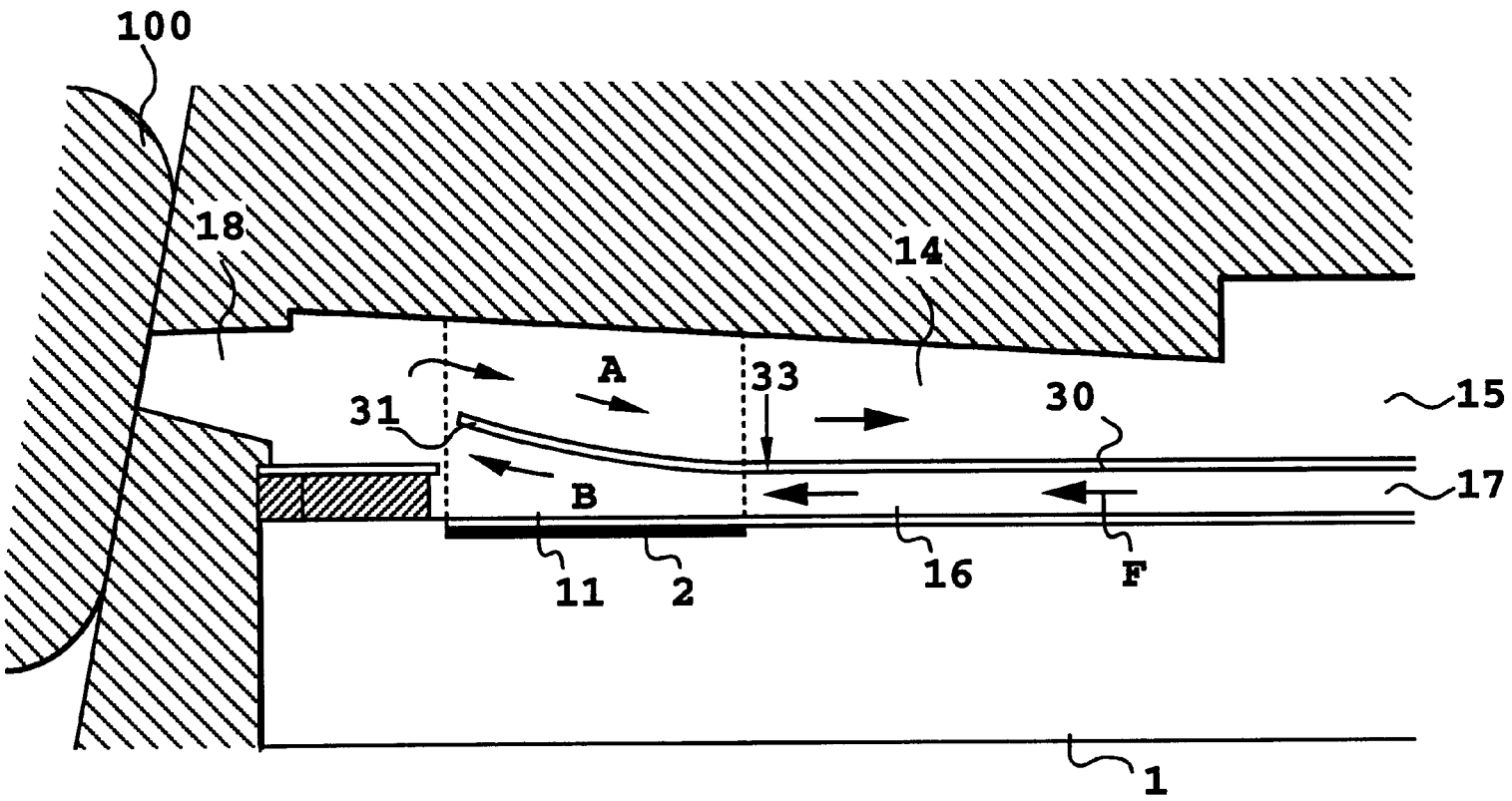
FIG. 10 is a cross sectional view that illustrates a method for preserving a liquid-ejection head as one of the preferred embodiment of the present invention.

A method for preserving a liquid-ejection head will be explained in detail with reference to FIG. 10. In the figure, the liquid-ejection head is the same one as that of FIGS. 9A and 9B except that an ejection port 18 of the former is closed by a closing member. Comparing with a second liquid, in this embodiment, a fist liquid is more difficult to adhere to the passage's inner wall and is more easy to recover from the condition of being adhered.

The method includes the following steps.

At first, an ejection port 18 is closed by the closing member 100 made of an elastic material such as a rubber. In the closed condition, a second liquid in the second liquid chamber 17 is forcefully moved into the second liquid-flowing passage 16 in the direction of the arrow F by means of a compressor (not shown, in the present embodiment, it may be a well-known pumping device). The compressed liquid in the second liquid-flowing passage 16 pushes up the movable member 31 and then enters into the first liquid-flowing passage 14. As the ejection port 18 is being closed by the closing member 100 as shown in the figure, the compressed second liquid flows through the first liquid-flowing passage 14, pushing the first liquid toward the first chamber 15. Consequently, the second liquid gradually substitutes for the first one. After a substantial portion of the first liquid have been taken away, there is the remainder of the first liquid close to the ejection port 18. In this case, however, the amount of the remainder is negligible and is substantially surrounded by the second liquid, so that it is resistant to thickening or sticking. In addition, even if the thickening or sticking is occurred, it is easily recovered to an initial state by a typical ejection-recovering operation. It is preferable to replace the first liquid with the second one so that the latter takes the place of the firmer around a supporting point of the movable member 31. More preferably, the first liquid flows up to a portion connecting between the first liquid-flowing passage 14 and the common liquid chamber 15.

After being left, the head returns to its original state by discharging the replaced liquid in the first liquid-flowing passage through the ejection port. The procedure for that discharge may be include the steps of moving the closing member to open the ejection port 18 and then performing a conventional recovery operation (e.g., a suction or pressure recovery operation using a cap member), a primary ejection, or the like.

Accordingly, the present invention provides the ways of: easily avoiding or reducing the possibility of causing the adhesion by replacing a liquid in one passage with the other which is comparatively difficult to adhere to the passage's inner wall and is comparatively easy to recover from the condition of being adhered; and easily recovering the head to its original state by discharging the second liquid in the first liquid-flowing passage simultaneously with a supply of fresh first liquid therein.

The present embodiment is represented as the head having the closing member for closing the ejection port. However, it is noted that it does not necessarily require the closing member when the head uses a liquid which can be gradually substituted using the meniscus-holding characteristics of the ejection port.

In the present embodiment, an example of replacing a liquid in one passage with the other which is comparatively difficult to adhere to the passage's inner wall is disclosed. However, it is not limited to. It is also possible to replace a liquid of high resistance to water with a liquid of low resistance to water or to replace a liquid of low surface tension with a liquid of high surface tension.

<Embodiment 2>

Figure 11:
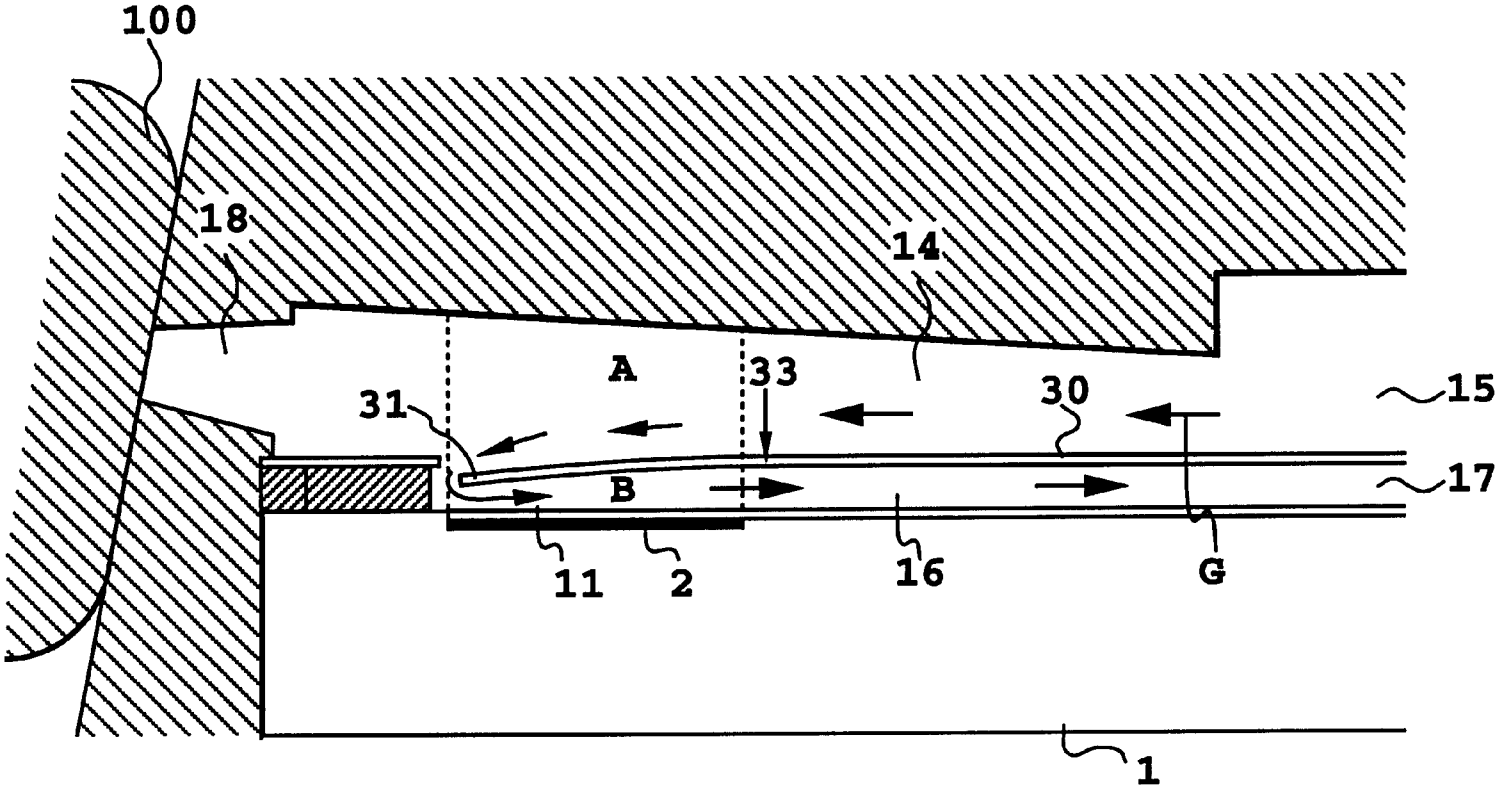
FIG. 11 is a cross sectional view that illustrates a method for preserving a liquid-ejection head as one of the preferred embodiment of the present invention.

A method for preserving a liquid-ejection head of the present embodiment will be explained in detail with reference to FIG. 11. In the figure, the liquid-ejection head is the same one as that of the first embodiment except that the second liquid can hardly adhere but easily recovered from the adhesion when it is occurred, compared with the first liquid.

The method includes the following steps. At first, an ejection port 18 is closed by a closing member 100 made of an elastic material such as a rubber. In the closed condition, a first liquid in a first liquid chamber 15 is forcefully moved into the first liquid-flowing passage 14 in the direction of the arrow G by means of a compressor (not shown). The compressed liquid in the fist liquid-flowing passage 14 pushes the movable member 31 in a downward direction and then enters into the second liquid-flowing passage 16. As the ejection port 18 is being closed by the closing member 100 as shown in the figure, the compressed first liquid flows through the second liquid-flowing passage 16, pushing the second liquid toward the second liquid chamber 17. Consequently, the first liquid gradually substitutes for the second one.

It is preferable to replace the first liquid with the second one so that the latter takes the place of the firmer around a supporting point of the movable member 31.

After being left, the head returns to its original state by discharging the replaced liquid in the second liquid-flowing passage through the ejection port. The procedure for that discharge may be include the steps of moving the closing member to open the ejection port 18 and then performing a conventional recovery operation (e.g., a suction or pressure recovery operation using a cap member), a primary ejection, or the like.

<Embodiment 3>

Figure 12:
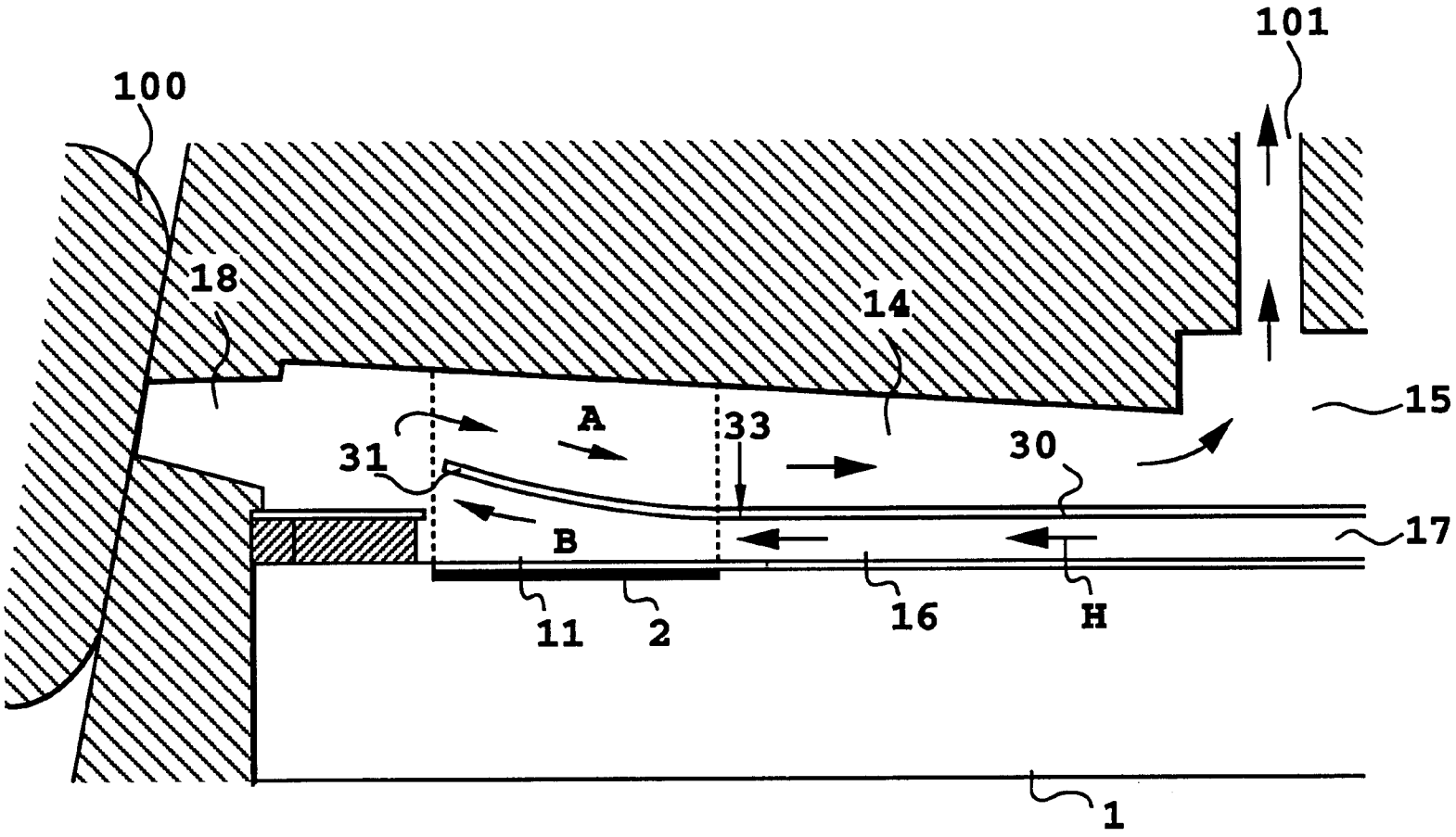
FIG. 12 is a cross sectional view that illustrates a method for preserving a liquid-ejection head as one of the preferred embodiment of the present invention.
Figure 13:
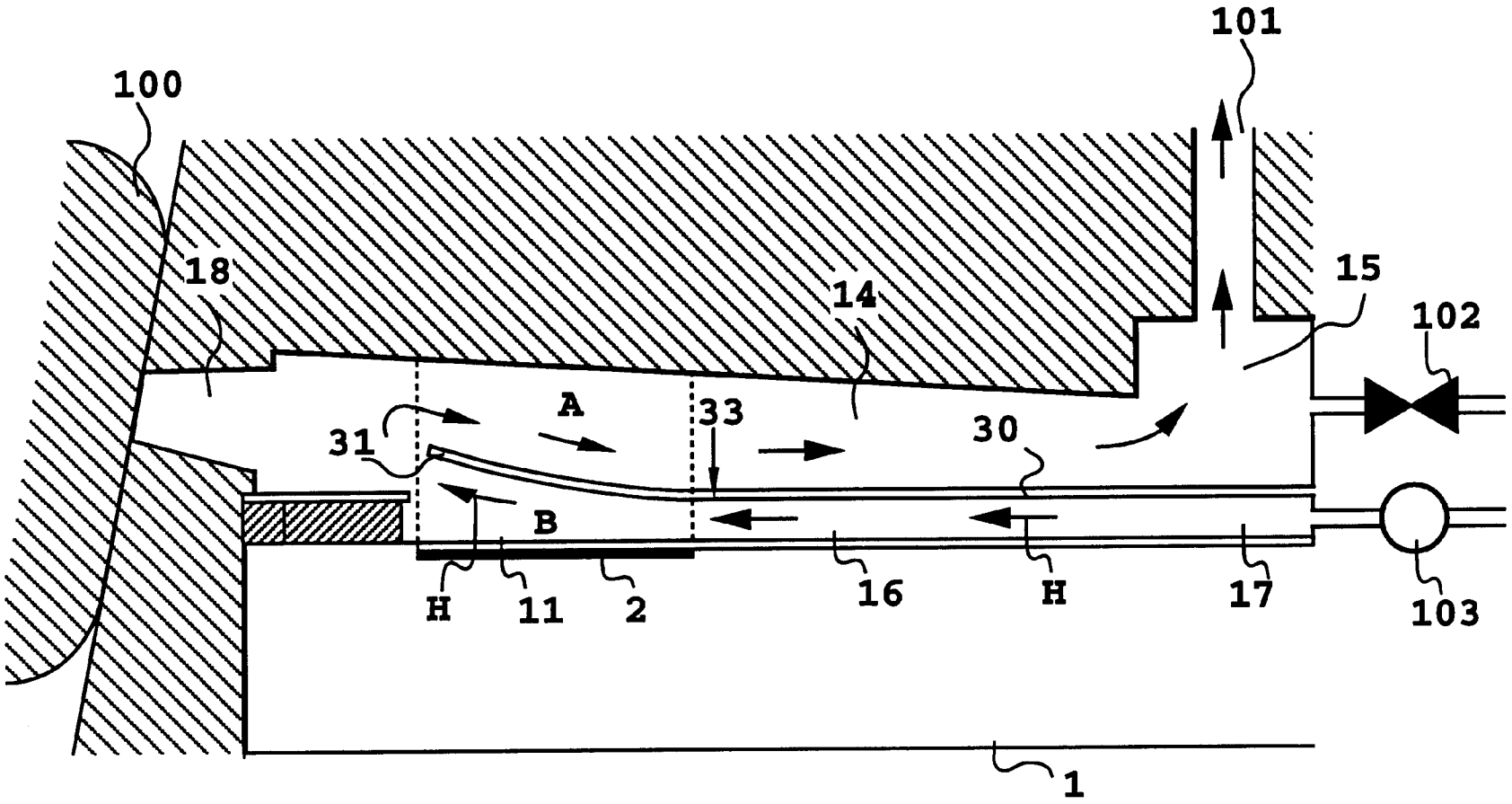
FIG. 13 is a schematic cross sectional view that shows a gas compressor to be used in the method for preserving the liquid-ejection head in accordance with the present invention.

A method for preserving a liquid-ejection head of the present embodiment will be explained in detail with reference to FIGS. 12 and 13. As shown in these figures, the liquid-ejection head is the same one as that of the first embodiment except that a first liquid common chamber 15 is communicated with a suction hole 101 being formed vertically. In this embodiment, furthermore, the second liquid can hardly adhere but easily recovered from the adhesion when it is occurred, compared with the first liquid. It is noted that a compressor system is schematically illustrated in FIG. 13. The compressor system comprises a valve 102 on the side of upper stream of the common liquid chamber 15 and a pump 103 on the side of upper stream of the second liquid-flowing passage 16.

The method includes the following steps. At first, an ejection port 18 is closed by a closing member 100 made of an elastic material such as a rubber while a liquid supply to the first liquid-flowing passage is blocked by means of the valve 103. In this condition, the first liquid in a first liquid-flowing passage 14 is drawn by suction through a suction passage 101. In this case, the ejection port 18 is closed by a closing member 100. Therefore, the second liquid is forcefully moved into the first liquid-flowing passage 14 in the direction of arrow H by the suction. For accelerating the suction time, an additional suction means may be provided, for example a compressor may be used for forcefully moving the second liquid in the same way as described in the first embodiment. That is, the second liquid is forcefully introduced by a pump 103 being arranged on the side of upstream of the second liquid-flowing passage.

The compressed liquid in the first liquid-flowing passage 14 pushes the movable member 31 in a downward direction and then enters into the second liquid-flowing passage 16. As the ejection port 18 is being closed by the closing member 100 as shown in the figure, the compressed first liquid flows through the second liquid-flowing passage 16, pushing the second liquid toward the second liquid chamber 17. Consequently, the first liquid gradually substitutes for the second one.

After being left, the head returns to its original state by discharging the replaced liquid in the first liquid-flowing passage through the ejection port. The procedure for that discharge may be include the steps of moving the closing member to open the ejection port 18 and then performing a conventional recovery operation (e.g., a suction or pressure recovery operation using a cap member), a primary ejection, or the like.

Accordingly, the present invention provides the ways of: easily avoiding or reducing the possibility of causing the adhesion by replacing a liquid in one passage with the other which is comparatively difficult to adhere to the passage's inner wall and is comparatively easy to recover from the condition of being adhered; and easily recovering the head to its original state by discharging the second liquid in the first liquid-flowing passage simultaneously with a supply of fresh first liquid therein.

The present embodiment is represented as the head having the valve member to be closed for the suction. However, it is noted that it does not necessarily require the valve member because the first liquid can be gradually substituted with the second liquid depending on the level of suction force or the level of forcefully moving the second liquid. By the way, it is preferable to close the valve for reducing the drained volume of the liquid.

In the present embodiment, the first liquid is replaced with the second one by sucking the liquid on the side of the first liquid-flowing passage through the suction hole but not limited to. It is also possible to form a suction hole for sucking the liquid on the side of second liquid-flowing passage to replace the second liquid with the first one.

<Embodiment 4>

Figure 14:
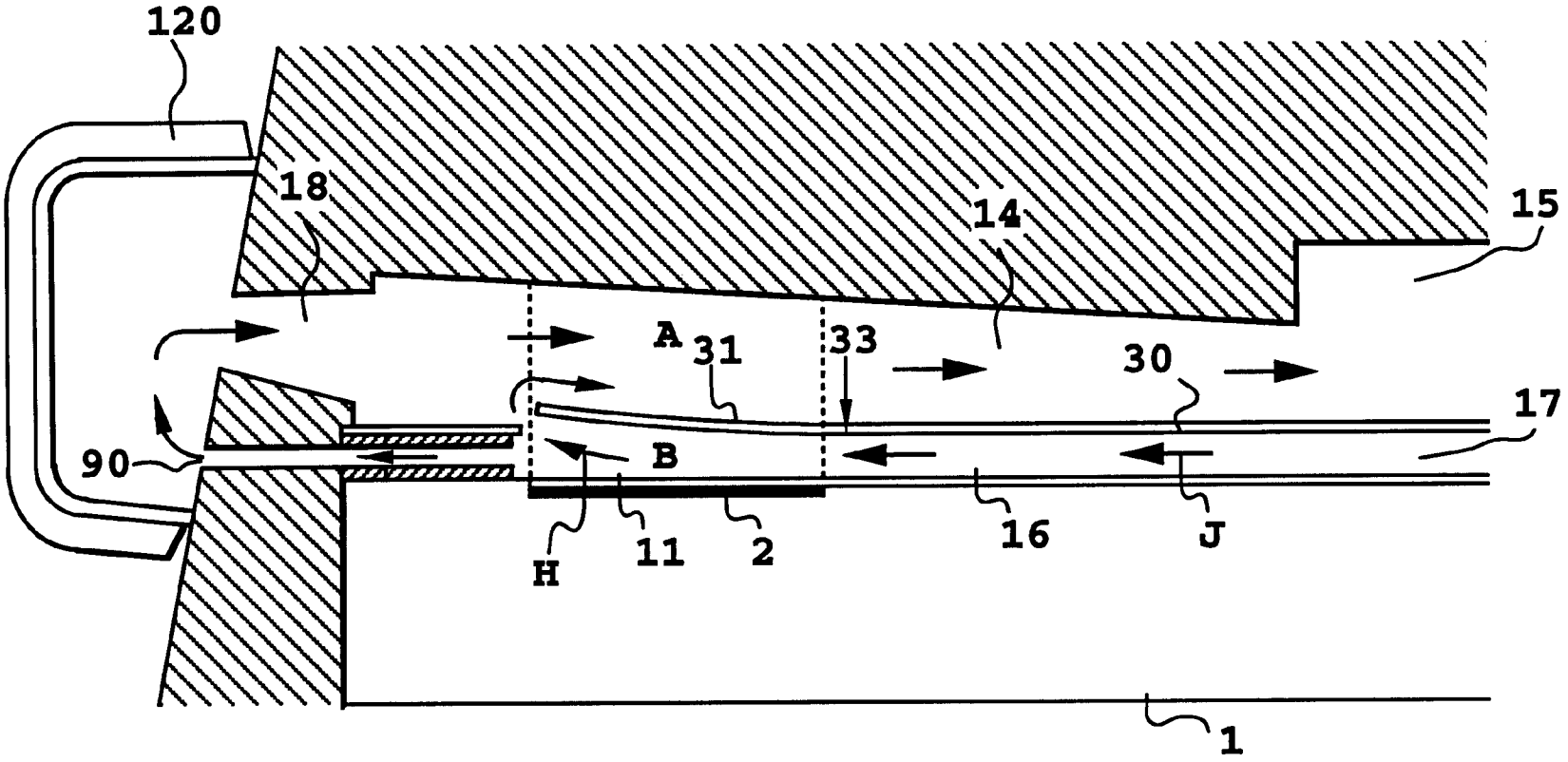
FIG. 14 is a cross sectional view that illustrates a method for preserving a liquid-ejection head as one of the preferred embodiment of the present invention.

In each of the above first, second, and third embodiments, the closing member is used for closing the ejection port 18 at the time of replacing the liquid in the liquid-flowing passage with the other liquid. In this embodiment, as shown in FIG. 14, a liquid-ejection head has a recovery port 90 directly communicating with a second liquid-flowing passage in addition to an ejection port 18 and a cap member 120 for capping the recovery port 90 and the ejection port 18 together for replacing the liquid.

The detailed configuration of the liquid-ejection head to be applied in the present embodiment will be described below in addition to its ejection recovery process.

The liquid-ejection head comprises a plurality of ejection ports 18 communicating with their respective first liquid-flowing passages 14, and a plurality of recovery ports 90 communicating with their respective second liquid-flowing passages 16. It is noted that the recovery port 90 is opened at a position between adjacent passages 16. In the figure, however, they are shown on the same cross section only for the purpose of simple illustration. In this embodiment, the second liquid can hardly adhere but easily recovered from the adhesion when it is occurred, compared with the first liquid.

The method includes the following steps. At first, the cap member 120 covers the ejection port 18 and the recovery port 90 together as if to form a single liquid-flowing passage between these ports 18, 90, so that they communicate with each other irrespective of whether the movable member 31 is displaced or not. In this condition, a second liquid in a second liquid chamber 17 is forcefully moved into the second liquid-flowing passage 16 in the direction of arrow J by means of a well-known pump means such as a compressor (not shown). Subsequently, the compressed liquid in the second liquid-flowing passage 16 pushes the movable member 31 in an upward direction. Then the liquid is separated into two volumes, in which one enters into the first liquid-flowing passage 14 directly while the other passes through the recovery port 90, an inside of the cap member 120, and the ejection port en route to the first liquid-flowing passage 14. Thus separated volumes are joined into one and then the second liquid flows through the first liquid-flowing passage 14, pushing the first liquid toward its chamber 15. Consequently, the second liquid gradually substitutes for the first one.

It is preferable to replace the second liquid with the first one so that the latter takes the place of the firmer around a supporting point of the movable member 31. More preferably, the second liquid flows up to a portion connecting between the first liquid-flowing passage 14 and the common liquid chamber 15.

After being left, the head returns to its original state by discharging the replaced liquid in the first liquid-flowing passage through the ejection port. The procedure for that discharge may be include the steps of moving the closing member to open the ejection port 18 and then performing a conventional recovery operation (e.g., a suction or pressure recovery operation using a cap member), a primary ejection, or the like.

Accordingly, the present invention provides the ways of: easily avoiding or reducing the possibility of causing the adhesion by replacing a liquid in one passage with the other which is comparatively difficult to adhere to the passage's inner wall and is comparatively easy to recover from the condition of being adhered; and easily recovering the head to its original state by discharging the second liquid in the first liquid-flowing passage simultaneously with a supply of fresh first liquid therein.

The present embodiment is represented as the head having the cap member for covering the ejection port and the recovery port together. However, it is noted that it is not necessarily require the cap member when the head uses a liquid which can be gradually substituted using the meniscus-holding characteristics of the ejection port.

In the present embodiment, an example of replacing a liquid in one passage with the other which is comparatively difficult to adhere to the passage's inner wall is disclosed. However, it is not limited to. It is also possible to replace a liquid of high resistance to water with a liquid of low resistance to water or to replace a liquid of low surface tension with a liquid of high surface tension.

<Ceiling Configuration of Liquid-flowing Passage>

Figure 15:
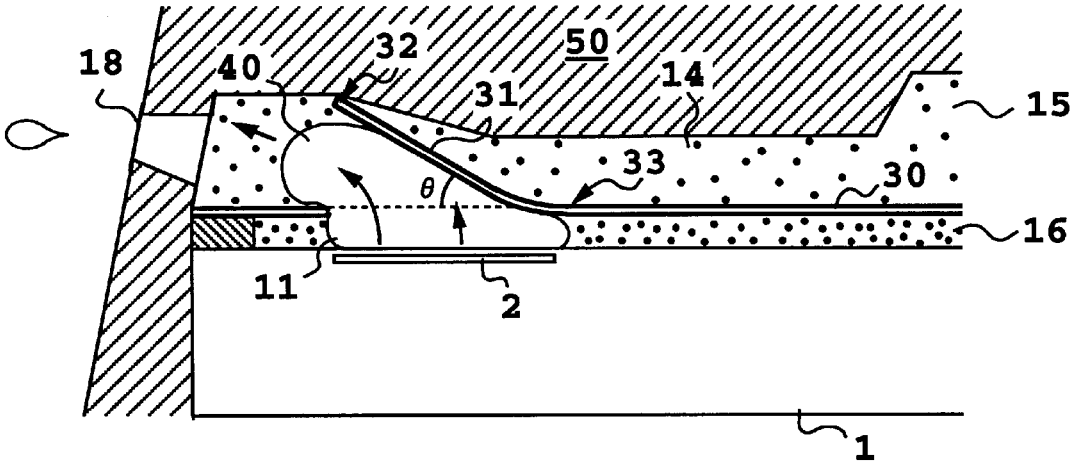
FIG. 15 is a schematic cross sectional view that illustrates the structural relationship between a movable member and a first liquid-flowing passage.

FIG. 15 is a sectional view that shows a liquid-ejection head as one of the preferred embodiments of the present invention.

As shown the figure, there is a grooved member 50 on the substrate 1. The groove member 50 has a grooved portion that defines the inner surface of the first liquid flow passage 14 (or the liquid-flowing passage 10 in FIG. 2) on the separation wall 30. In the present embodiment, the height of the ceiling or an upper plate of the liquid-flowing passage in the vicinity of the position of the free end 32 of the movable member 31 is high to provide greater operation angle θ of the movable member 31. The operation range of the movable member 31 may be determined with taking the structure of the liquid-flowing passage 14, durability of the movable member 31, the bubble generation force and so on. It is desirable that the operation range of the movable member 31 permits operation up to the angle including the axial direction of the ejection port 18.

On the other hand, as shown in this figure, by proving greater high of the displacement of the free end 32 of the movable member 31 than the diameter of the ejection port 18, further sufficient ejection force can be transmitted. Also, as shown in this figure, since the height of the upper plate of the liquid-flowing passage 14 at the position of the fulcrum 33 of the movable member 31 is lower than the height of the upper plate of the liquid-flowing passage 31 at the position of the free end of the movable member, surge of the pressure wave toward the upstream side can be further effectively prevented.

<Positional Relationship between Second Liquid-flowing Passage and Movable Member>

Figure 16A:
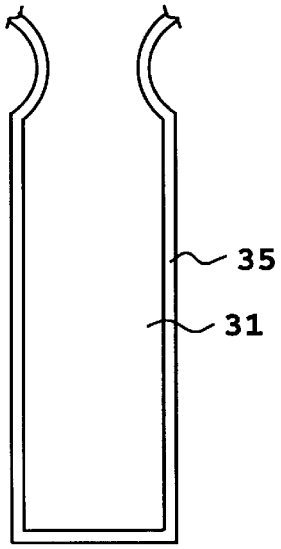
FIGS. 16A–16C are schematic representations that illustrate the structural relationship between a movable member and liquid-flowing passages.
Figure 16B:
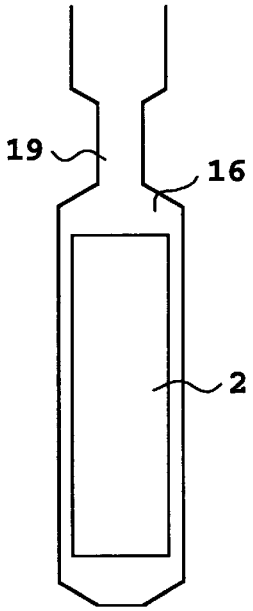
Figure 16C:
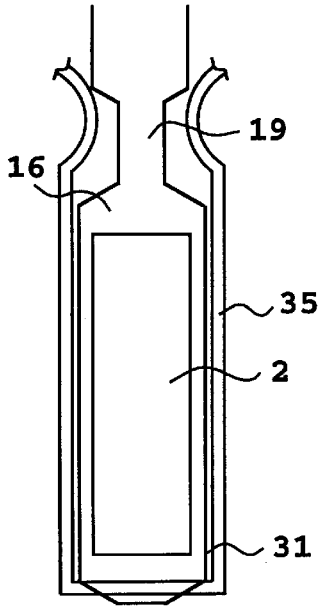

FIGS. 16A, 16B and 16C are illustration for explaining positional relationship between the movable member 31 and the second liquid-flowing passage 16. FIG. 16A is an illustration of the portion in the vicinity of the separation and the movable member 31 as viewed from the above, FIG. 16B is an illustration showing the second liquid-flowing passage 15 with removing the separation wall 30, as viewed from the above, and FIG. 16C is an illustration showing positional relationship of the movable member 31 and the second liquid-flowing passage 16 as illustrated diagrammatically by overlapping respective elements. It should be noted that in all figures, lower side in the drawings are the front face side where the ejection port arranged.

The second liquid-flowing passage 16 of the present embodiment has a narrowed portion 18 at the upstream side of the heater 2 (here, upstream side means the upstream side in the flow from the second common liquid chamber to the ejection port via the heater position, the movable member and the first liquid-flowing passage) to define a chamber structure (the bubble generation chamber) which successfully prevent the pressure generated by the bubble generation from easily escaping toward the upstream side of the second liquid-flowing passage 16.

In conventional case of the head where the liquid-flowing passage for generating a bubble and the liquid-flowing passage for ejecting the liquid are common and the narrowed portion is provided to prevent the pressure generated at the liquid chamber side of the heater from escaping, it was necessary to take a constriction, in which the liquid flow sectional area in the narrowed position is not too small in view of re-fill of the liquid.

However, in the present embodiment, large proportion of the liquid to be ejected is the ejection liquid in the first liquid-flowing passage, and the bubble-generation liquid in the second liquid-flowing passage where the heater is provided, is not consumed in significant amount. Therefore, re-fill amount of the bubble-generation liquid to the bubble generation area 11 of the second liquid-flowing passage can be small. Accordingly, the distance in the narrow portion 19 can be quite small in the extent of several $\mu$m to several ten $\mu$m. Therefore, the pressure generating in the second liquid-flowing passage during the bubble generation can be restricted from escape to the circumference to concentrically direct to the movable member. Since this pressure can be used as ejection force via the movable member 31, higher ejection efficiency and higher ejection force can be achieved. It should be appreciated that the configuration of the first liquid-flowing passage 16 is not limited to the foregoing construction, and can be of any shape, through which the pressure generated by the bubble generation can be effectively transmitted to the movable member side.

As shown in FIG. 16C, the side portion of the movable member 31 covers a part of the wall forming the second liquid-flowing passage 16. By this, dropping down of the movable member into the second liquid-flowing passage is successfully prevented. This enhances separation between the ejection liquid and the bubble-generation liquid to improve the ejection pressure and the ejection efficiency. Also, it becomes possible to perform re-fill from the upstream side by utilizing the negative pressure upon extinction of bubble.

In FIG. 15, associating with displacement $\theta$ of the movable member 31 toward the first liquid-flowing passage 14 side, a part of the bubble generated in the bubble generation area of the second liquid-flowing passage 16 extends into the first liquid-flowing passage 14, by selecting height of the second liquid-flowing passage 16 so that the bubble extends into the first liquid-flowing passage 14, the ejection force can be improved in comparison with the case where the bubble may not extend into the first liquid-flowing passage. As set forth, in order to extend the bubble into the first liquid-flowing passage 14, it is desirable to set the height of the second liquid-flowing passage 16 smaller than the maximum diameter of the bubble. Preferably, the height may be set within a range of several $\mu$m to 30 $\mu$m. It should be noted that, in the present embodiment, this height is set at 15 $\mu$m.

<Movable Member and Separation Wall>

FIGS. 16A, 16B, and 16C show another configuration of the movable member, in which the reference numeral 35 denotes a slit provided in the separation wall. By forming this slit 35, the movable member 31 is formed and shaped. In these figures, FIG. 16A shows a rectangular shaped configuration of the movable member 31, in which the fulcrum side is formed thinner to facilitate operation of the movable member 31, FIG. 16B shows the second liquid passage 16 and the heater 2, in which the upstream side of the second liquid passage 16 is narrowed, and FIG. 16C shows the relationship among the shapes of those contractual elements. For achieving easiness of operation and reasonable durability, it is preferable that the movable member 35 has a narrowed portion with semicircular cut-outs at the fulcrum side 33 as illustrated in FIG. 16. According to the configuration shown in those figures, furthermore, the movable member 31 does not enter into the second liquid-flowing passage 16 at any conditions, so that it moves smoothly and achieves high durability.

In the former embodiment, the plate form movable member 31 and the separation wall 30 are made of a single nickel plate of 5 $\mu$m thick. However, as the material of the movable member and the separation wall, any material which has sufficient resistance to solvent against the bubble-generation liquid and the ejection liquid, sufficient elasticity for satisfactory operation, and sufficient workability for permitting formation of fine slit. As material usable for the movable member, it is desired to be selected from the materials having high durability, consisting of metal, such as silver, nickel, gold, iron, titanium, aluminum, platinum, tantalum, stainless steel, phosphor bronze or the like, resin containing nitrile group, such as acrylonitrile, butadiene, styrene or the like, resin containing amide group, such as polyamide or the like, resin containing carboxyl group, such as polycarbonate or the like, resin having aldehyde group, such as polyacetal or the like, resin containing sulfone group, such as polysulfone, other resin, such as liquid crystal polymer or the like, and compounds thereof having high ink resistance, consisting of metal, such as gold, tungsten, tantalum, nickel, stainless steel, titanium or the like, alloy thereof, one coated on the surface with respect to the ink resistance, resin having amide group, such as polyamide or the like, resin having aldehyde group, such as polyacetal or the like, resin containing ketone group, such as polyether ether ketone or the like, resin containing imide group, such as polyimide or the like, resin containing hydroxyl group, such as phenol or the like, resin containing ethyl group, such as polyethylene or the like, resin having alkyl group, such as polypropylene, resin having epoxy group, such as epoxy resin or the like, resin containing amino group, such as melamine formaldehyde resin, methylol group, such as xylene resin or the like, and their compound, and ceramic, such as silicon dioxide and compounds thereof.

As a material usable for the separation wall, resin having high heat resistance, solvent resistance, molding ability typically represented by recent engineering plastic, such as polyethylene, polypropylene, polyamide, polyethylene terephthalate, melamine resin, phenol resin, epoxy resin, polybutadiene, polyurethane, polyether ether ketone, polyether sulfone, polyarylate, polyimide, polysulfone, liquid crystal polymer (LCP) or so forth or their compound, metal, such as silicon dioxide, silicon nitride, nickel, gold, stainless steel or the like and compounds thereof, or one provided coating of titanium or gold.

On the other hand, the thickness of the separation wall may be determined in consideration of the material and shape or so forth in viewpoint of strength as the separation wall or good operation as the movable member, and is desirably 0.5 $\mu$m to 10 $\mu$m.

<Substrate of the liquid-ejection Head>

Figure 17A:
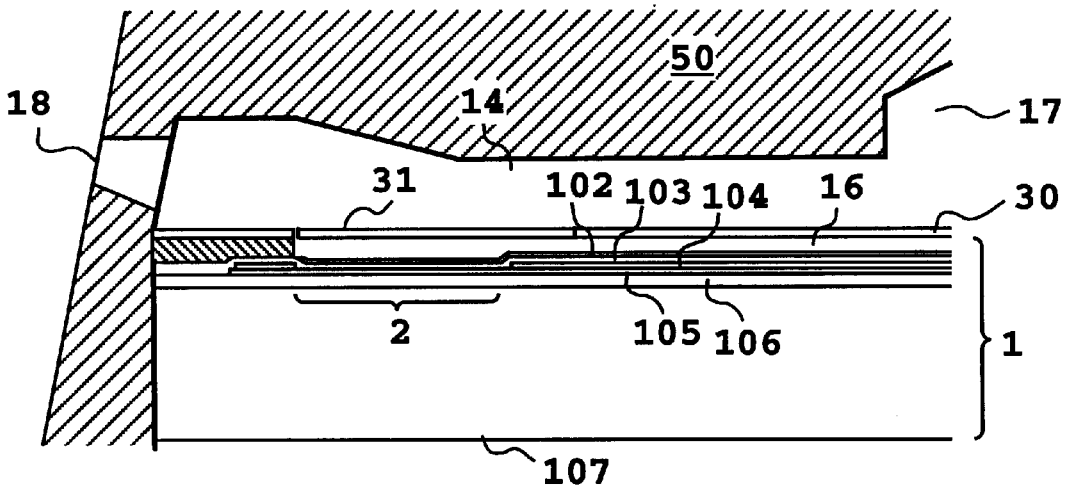
FIG. 17 is a vertical cross sectional view that shows a liquid-ejection head with a protective coat in accordance with the present invention.
FIG. 17B is a vertical cross sectional view that shows a liquid-ejection head without a protective coat in accordance with the present invention.
Figure 17B:
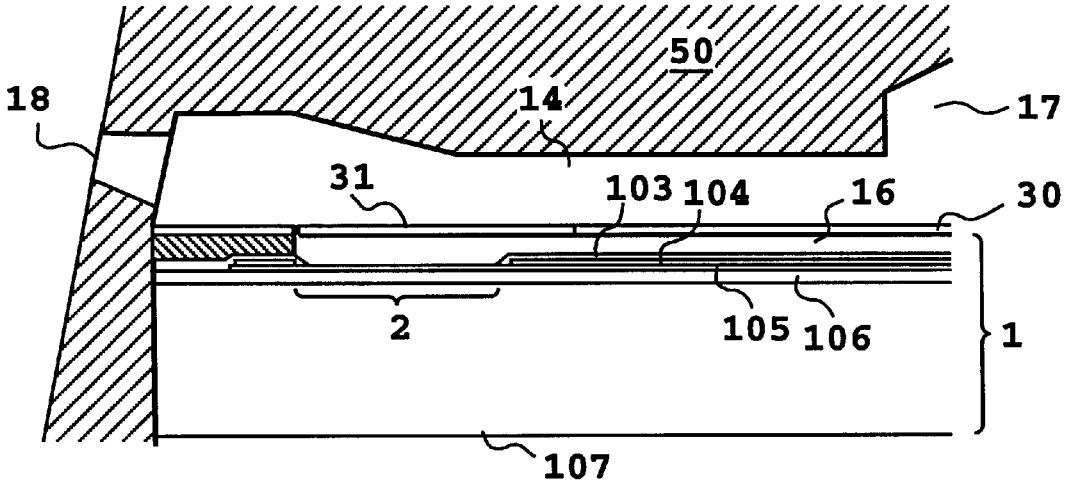

Referring now to FIGS. 17A and 17B, the construction of the substrate 1, on which the heater 2 is provided for applying heat to the liquid, will be explained below.

FIGS. 17A and 17B are longitudinal sections of the liquid-ejection head according to the present invention, wherein FIG. 17A shows the head with a protective layer set out later, and FIG. 17B is the head having no protective layer.

On the substrate 1, the second liquid-flowing passage 16, the separation wall 30, the first liquid-flowing passage 14 and the grooved member 50 formed with the groove for defining the first liquid-flowing passage 14 are arranged.

In the substrate 1, silicon oxide layer or silicon nitride layer 106 for insulation and heat accumulation is deposited on a substrate 107 of silicon or the like. On the silicon oxide layer or silicon nitride layer 106, an electric resistor layer 105 (0.01 to 0.2 $\mu$m thick), such as hafnium diboride ($HfB_2$), tantalum nitride (TaN), tantalum aluminum (TaAl) or the like, and a wiring electrodes 104 (0.2 to 1.0 $\mu$m thick) of aluminum or the like are patterned. Applying a voltage from the two wiring electrodes to the resistor layer 105 to flow a current to generate a heat. On the resistor layer between the wiring electrodes, a protective layer of 0.1 to 2.0 $\mu$m thick is formed with silicon oxide or silicon nitride. Furthermore, over the protective layer, an anti-cavitation layer (0.1 to 9.6 $\mu$m thick) of tantalum or the like is deposited for protecting the resistor later 105 from various liquid, such as an ink.

Particularly, the pressure to be generated upon extinction of bubble or impulsive wave is quite strong to significantly lower durability of stiff and brittle oxide layer. Therefore, the metal, such as tantalum (Ta) or the like is used as the anti-cavitation layer.

Figure 20:
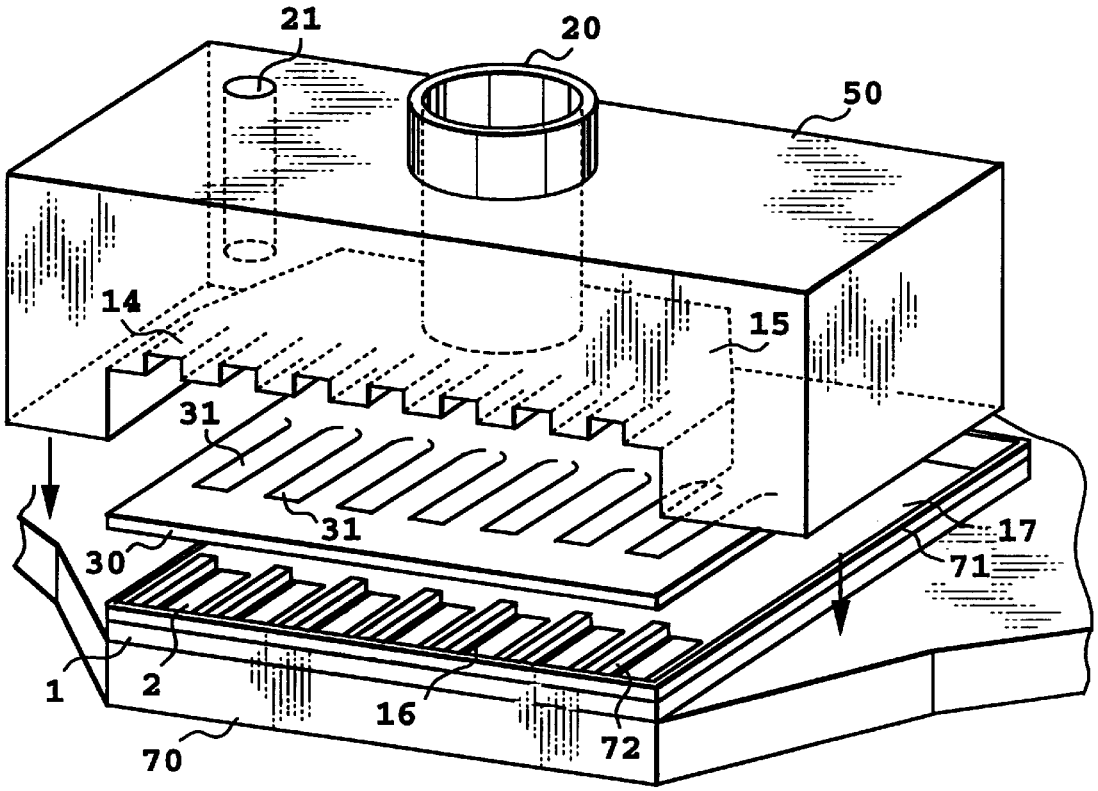
FIG. 20 is an exploded perspective view that shows a construction of a liquid-ejection head as one of the preferred embodiment of the present invention.

On the other hand, by combining the liquid, the liquid-flowing passage construction, resistor material, it can be establish a structure which does not require the protective layer, as shown in FIG. 20B. As a material for the resistor layer which does not require the protective layer, iridium-tantalum-aluminum alloy or the like may be employed.

As set forth above, as the construction of the heater in the foregoing respective embodiment, it may be only the resistor layer (heating portion), or in the alternative, the protective layer may be formed for protecting the resistor layer.

In the present embodiment, the heating portion constructed with the resistor layer which generates a heat in response to the electric signal, is employed as the heater. However, the heater is not specified to the shown construction but can be of any construction as long as sufficient bubble can be generated in the bubble-generation liquid. For example, an optical-thermal transducer heated by receiving a light, such as a laser beam or the like or a heating body to be heated in response to a high frequency, may be employed.

It should be noted that on the foregoing substrate 1, in addition to the resistor layer 105 forming the heating portion and the electrothermal transducer constructed with the wiring electrodes 104 for supplying the electric signal to the resistor layer, transistors, diodes, latch, shift register and so on are integrally formed through a semiconductor fabrication process.

Figure 18:
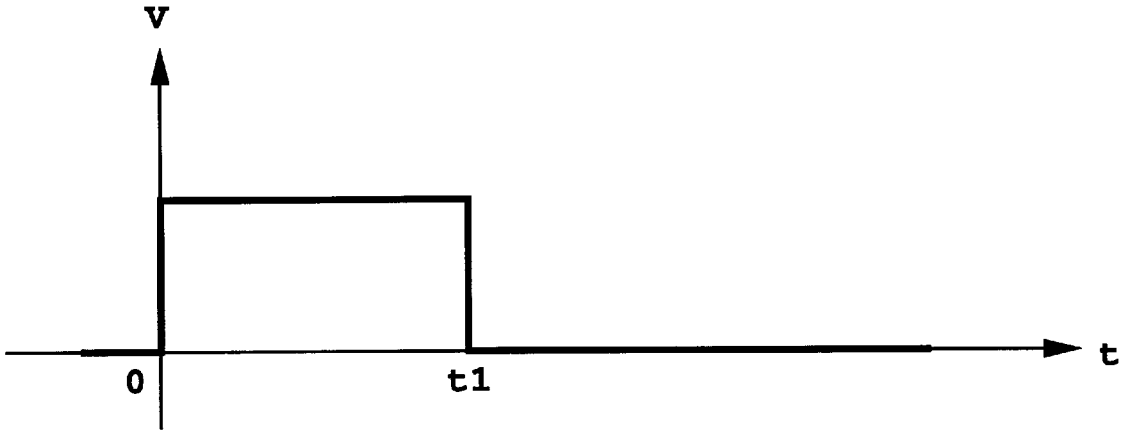
FIG. 18 is a waveform chart that shows a waveform of a driving pulse to be applied in a liquid-ejection head of the present invention.

On the other hand, in order to drive the heating portion of the electrothermal transducer provided on the substrate for ejecting the liquid, a rectangular pulse as shown in FIG. 18 is applied to the resistor layer 105 via the wiring electrodes 104 to abruptly heat the resistor layer between the wiring electrodes. In the head of respective of the foregoing head, a voltage 24V, a pulse width 7 msec, a current 150 mA are applied as the electric signal at a frequency of 6 kHz to drive the heater. By the foregoing operation, the liquid is ejection from the ejection ports. However, the condition of the driving signal is not limited to the above, but can be of any driving signal which can appropriately generate a bubble in the bubble-generation liquid.

<Head Structure with Dual Liquid-flowing passage Construction>

Hereinafter, an embodiment of the liquid-ejection head which can satisfactorily introduce mutually different liquid in the first and second common liquid chamber to contribute for reduction of number of parts and thus to enable lowering of the cost.

Figure 19:
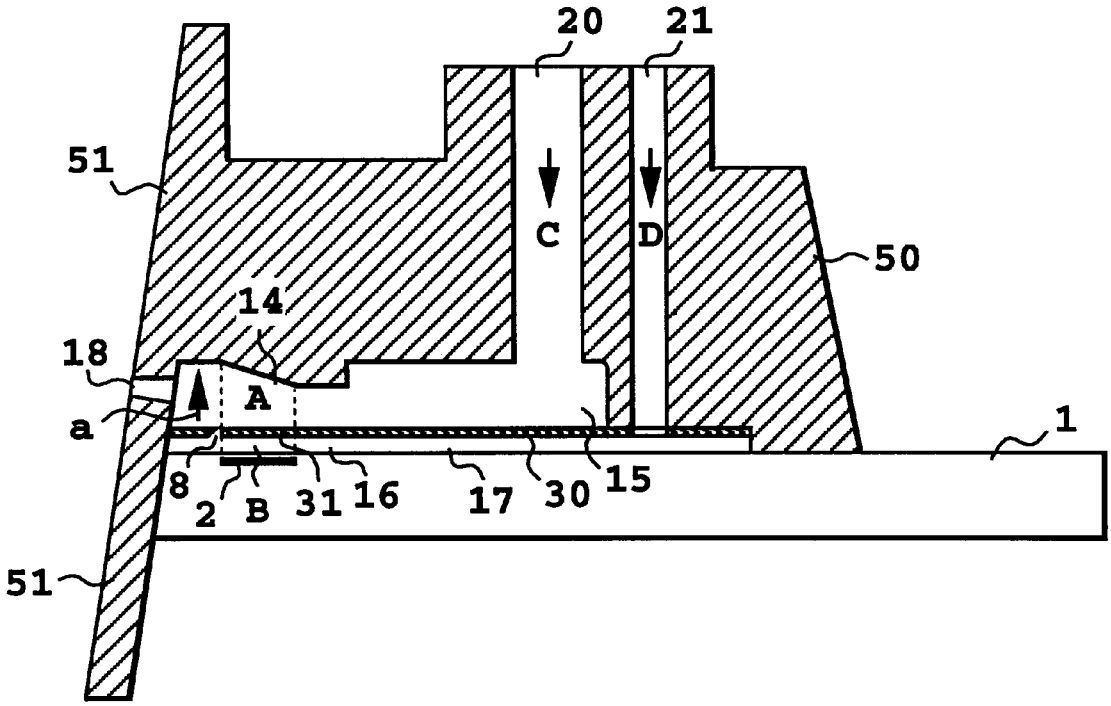
FIG. 19 is a cross sectional view that illustrates a feed passage formed in a liquid-ejection head of the present invention.

FIG. 19 is a diagrammatic illustration showing a structure of the liquid-ejection head. It should be noted that like elements to the former embodiments will be identified by the same reference numeral and detailed description therefor keep the disclosure simple enough to facilitate clear understanding of the invention.

In the present embodiment, the grooved member 50 is generally comprises an orifice plate 51 having the ejection ports. A plurality of grooves forming a plurality of first liquid-flowing passages 14 and a cavity forming the first common liquid chamber 15 for supplying the liquid (ejection liquid) to each of the first liquid-flowing passage 3.

On the lower portion of the grooved member 50, the separation wall 30 is coupled to define a plurality of the first liquid-flowing passage 14 can be formed. Such grooved member 50 has a first liquid supply passage 20 reaching into the first common liquid chamber 15 from the above. Also, the grooved member 50 has the second liquid supply passage 21 extending through the separation wall 30 to reach the second common liquid chamber 17.

Figure 22:
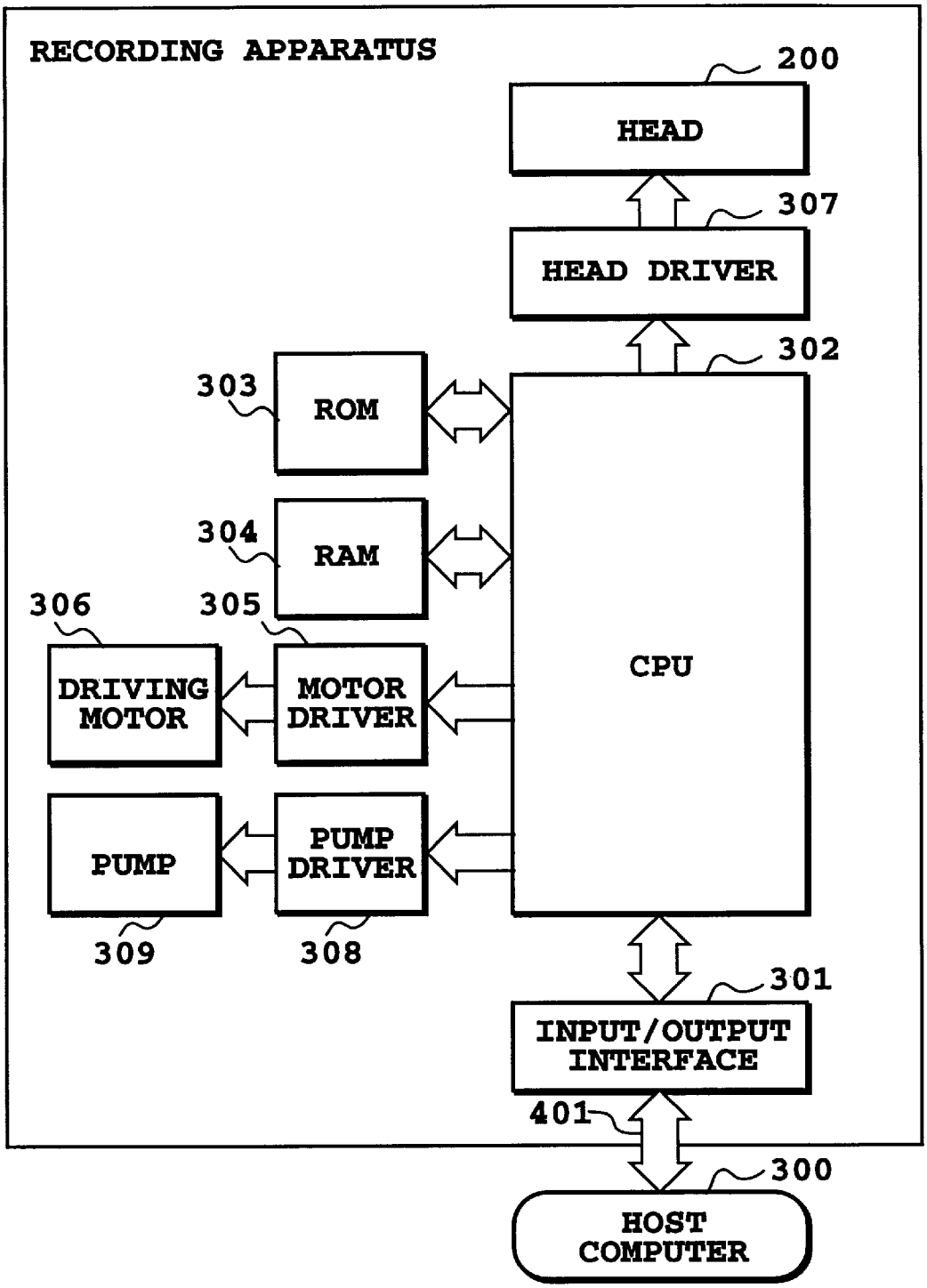
FIG. 22 is a block diagram that illustrates a configuration of a liquid-ejection apparatus in accordance with the present invention.

The first liquid (ejection liquid) is supplied to the first common liquid chamber 15 via the first liquid supply passage 20, and then supplied to the first liquid-flowing passage 14, as shown by arrow C in FIG. 22. On the other hand, the second liquid (bubble-generation liquid) is supplied to the second common liquid chamber 17 via the second liquid supply passage 21, and then supplied to the second liquid-flowing passage 16 as shown by arrow D in FIG. 19.

In the present embodiment, the second liquid supply passage 21 is arranged in parallel to the first liquid supply passage 20. However, the layout of the first and second liquid supply passages 20 and 21 is not specified to the shown arrangement, but any arrangement may be employed as long as the first common liquid chamber 15 extends through the separation wall 30 arranged at the outer side of the first common liquid chamber 15.

On the other hand, the thickness (diameter) of the second liquid supply passage 21 is determined in view of the supply amount of the liquid therethrough. The cross section of the second liquid supply passage 21 is not necessarily circular but can be of any appropriate configuration, such as rectangular or the like.

On the other hand, the second common liquid chamber 17 may be defined by separating the grooved member 50 with the separation wall. As a method of forming, as shown by exploded perspective view shown in FIG. 23, it can be formed by forming the common liquid chamber frame and the second liquid-flowing passage by a dry film, on the substrate, and an assembly of the grooved member 50 with the separation wall 30 coupled to the former are bonded to the substrate 1 to form the second common liquid chamber 17 and the second liquid-flowing passage 16.

In the present embodiment, on the support body formed with a metal, such as aluminum or the like, the substrate 1 which is provided with a plurality of electrothermal transducer element as the heater for generating heat for generating the bubble by film boiling.

On the substrate 1, a plurality of grooves forming the liquid-flowing passages 16 defined by the second liquid-flowing passage wall, a cavity forming the second common liquid chamber (common bubble-generation liquid chamber) for supplying bubble-generation liquid, and the separation wall provided with the movable member 31 are arranged.

The reference numeral 50 denoted the grooved member. The grooved member includes the groove forming the ejection liquid-flowing passage (first liquid-flowing passage), the cavity for forming the first common chamber (common ejection liquid chamber) 15 for supplying the ejection liquid to the ejection liquid-flowing passage, the first supply passage (ejection liquid supply passage) 20 for supplying the liquid to the first common liquid chamber, and the second supply passage (bubble-generation liquid supply passage for supplying the bubble-generation liquid to the second common liquid chamber 17. The second supply passage 21 is connected to a communication path which is, in turn, communicated with the second common liquid-flowing passage 17 through the separation wall 30 located outside of the first common liquid chamber 17. By this communication passage, the ejection liquid is supplied to the second common liquid chamber 15 without causing admixing with the ejection liquid.

It should be noted that the positional relationship between the substrate 1, the separation wall 30 and the grooved upper plate 50 is that the movable member 31 is arranged opposing to the to the heater 1 of the substrate 1. Corresponding to the movable member 31, the ejection liquid-flowing passage 14 is arranged. On the other hand, in the present embodiment, there is illustrated the embodiment, in which the second supply passage is arranged in one of the grooved members. However, it is possible to provide a plurality of the second liquid supply passage. Furthermore, the cross sectional areas of the ejection liquid supply passage 20 and the bubble-generation liquid supply passage 21 may be determined depending upon supply amount of the ejection liquid and the bubble generation region.

Thus, by optimization of the cross section area, the parts forming the grooved member 50 and so on can be made more compact.

With the present embodiment set forth above, the second supply passage supplying the second liquid to the second liquid-flowing passage and the first supply passage supplying the first liquid to the first liquid-flowing passage are formed on the common grooved member serving as grooved upper plate. Thus, number of parts becomes smaller to permit shortening of the process to result is lowering of the cost.

On the other hand, the supply of the second liquid to the second common liquid chamber communicated with the second liquid-flowing passage is performed by the second liquid-flowing passage in a direction extending through the separation wall separating the first and second liquid. This requires bonding process of the separation wall, the grooved member and the substrate formed with the heaters can be done at one time to improve easiness of fabrication and improve bonding accuracy to results in good ejection.

On the other hand, since the second liquid is supplied to the second common liquid chamber through the separation wall, supply of the second liquid to the second liquid-flowing passage can be assured to certainly reserve sufficient amount to permit stable ejection.

<Ejecting Liquid and bubble-generation liquid>

As explained with respect to the former embodiment, the present invention is able to perform ejection with higher ejection pressure, higher ejection efficiency and higher speed than the conventional liquid-ejection head, with the construction where the movable member is provided. Among the present embodiments, when the same liquid used for the bubble-generation liquid and the ejecting liquid, various liquid may be employed as long as the liquid may not be degraded by the head applied from the heater, is difficult to cause deposition on the heater by heating, is capable of reversible state variation between vaporized state and the condensed state, and may not cause fatigue the liquid-flowing passage, the movable member separation wall or the like.

Amongst such liquid, as the liquid for performing printing (printing liquid), an ink having composition used in the conventionally ink employed in the conventional bubble-jet apparatus.

On the other hand, when the dual flow passage is employed, and the ejection liquid and when the ejection liquid and the bubble-generation liquid are mutually distinct, any liquid which can satisfy the foregoing condition may be used. In practice, methanol, ethanol, n-propanol, isopropanol, n-hexane, n-heptan, n-octan, toluene, xylene, methylene dichloride, tricrene, freon TF, freon BF, ethyl ether, dioxane, cyclohexane, methyl acetate, ethyl acetate, acetone, methyl ethyl ketone, water and the like, and their mixture can be the material for the bubble-generation liquid.

As the ejection liquid, various liquid may be employed irrespective of the bubble generation ability and thermal property. Also, the liquid having low bubble generation ability, the liquid which is easily cause alternation or degradation by heat, or high viscous liquid, which have been considered difficult to use, can be used.

However, it is desired that the liquid may not obstruct ejection, bubble generation, operation of the movable member or provide any adverse effect for the heat operation, by in nature of the ejection liquid or by reaction with the bubble-generation liquid.

As the ejection liquid for printing, high viscous ink and the like can be used. As other ejection liquid, a liquid of pharmaceutical preparations, perfume and the like may also be used.

In the present invention, printing was performed using the ink having the following composition as a printing liquid which can be used both for the ejection liquid and the bubble-generation liquid. As a result, it has been found that owing to improvement of ejection force, the ink ejection speed became higher to results in improvement of accuracy of hitting of the liquid droplet to quite good printing image could be obtained.

| A composition of the dye ink (viscosity 2 cps) | |
|---|---|
| (C.I. food black 2) dye | 3 Wt % |
| diethylene glycol | 10 Wt % |
| thiodigylcol | 5 Wt % |
| ethanol | 3 Wt % |
| water | 77 Wt % |

Also, printing was performed by ejection with combining a liquid having the following composition with the bubble-generation liquid and the ejection liquid. As a result, ejection could be performed for the liquid having viscosity of several ten cp. which has been difficult to eject in the conventional head, and even for the liquid having quite high viscosity of 150 cp. to achieve high quality printing product.

A composition of the bubble-generation liquid 1

| | |
|---|---|
| ethanol | 40 Wt % |
| water | 60 Wt % |

A composition of the bubble-generation liquid 2

| | |
|---|---|
| water | 100 Wt % |

A composition of the bubble-generation liquid 3

| | |
|---|---|
| isopropanol alcohol | 10 Wt % |
| water | 90 Wt % |

A composition of the ejection liquid 1 (viscosity 15 cps)

| | |
|---|---|
| carbon black 5 | 5 Wt % |
| Styrene-acrylic acid-acrylethyl copolymer | 1 Wt % |

(Acid value: 140, Weight-average molecular weight: 8000)

| | |
|---|---|
| monoethanol amine | 0.25 Wt % |
| glycerin | 69 Wt % |
| thioglycol | 5 Wt % |

-continued

| | |
|---|---|
| ethanol | 3 Wt % |
| water | 16.75 Wt % |

A composition of the ejection liquid 2 (viscosity 55 cps)

| | |
|---|---|
| polyethylene glycol 200 | 100 Wt % |

A composition of the ejection liquid 3 (viscosity 150 cps)

| | |
|---|---|
| polyethylene glycol 600 | 100 Wt % |

In case of the liquid which has been considered difficult to eject in the prior art, difficulty in obtaining high quality image has been encountered for low ejection speed which promotes fluctuation of the ejecting direction to lower accuracy of the hitting position of the liquid droplet on the printing medium, or for fluctuation of ejection amount due to instability of ejection. However, in the foregoing embodiment, satisfactory bubble generation can be obtained by using the bubble-generation liquid with high stability. This results in improvement of accuracy of the hitting position of the liquid drop and stabilization of ink ejection amount to enable significant improvement of the printing image quality.

<Liquid Ejecting Apparatus>

Figure 21:
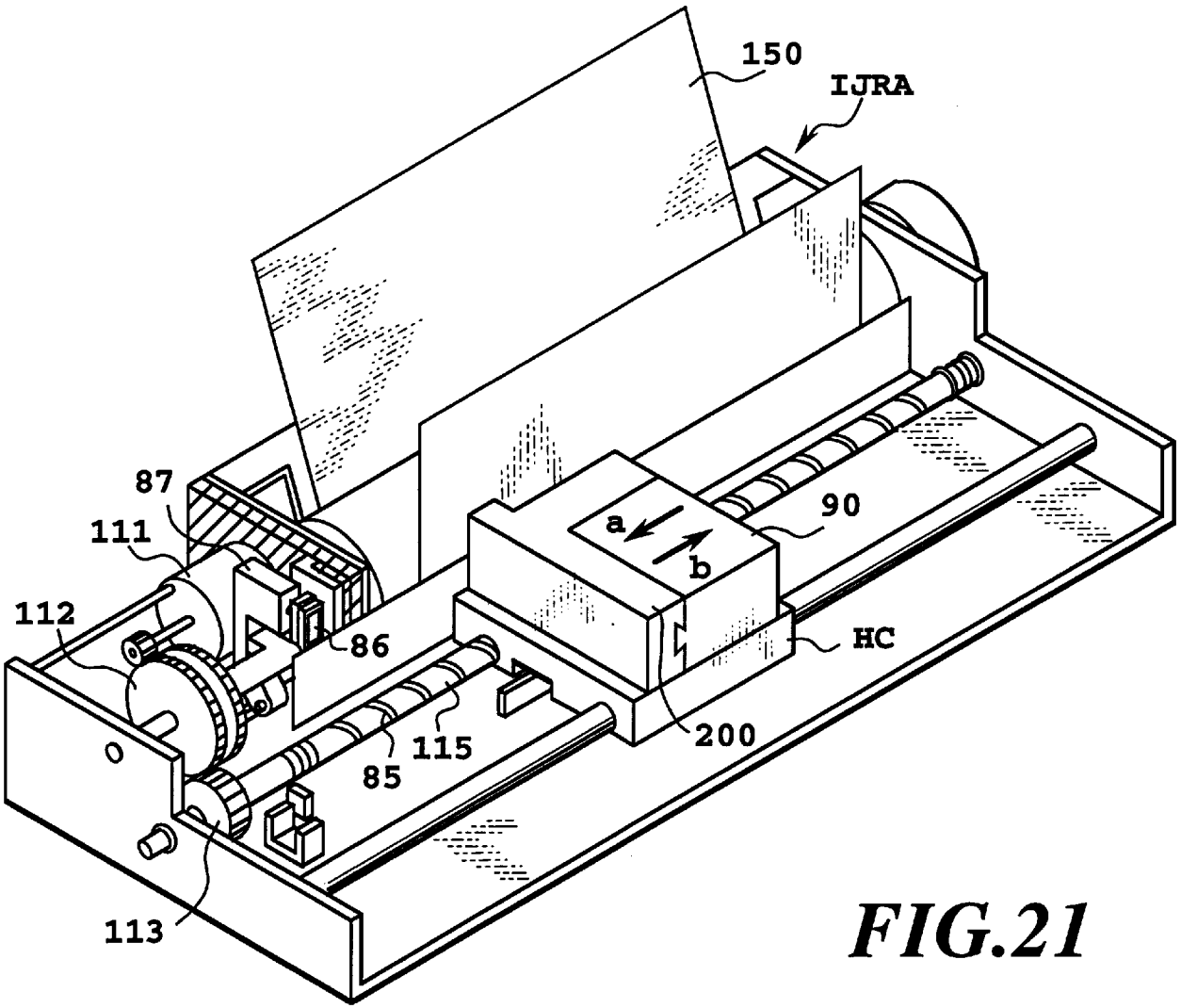
FIG. 21 is perspective view that shows a liquid-ejection apparatus in accordance with the present invention.

FIG. 21 generally shows a liquid ejecting apparatus mounting the foregoing liquid-ejection head. FIG. 22 is a block diagram that illustrates a configuration of the liquid-ejection apparatus of FIG. 21. In the present embodiment, explanation will be given particularly for an ink ejecting printing apparatus using the ink as the ejection liquid. A carriage HC of the liquid ejecting apparatus mounts a head cartridge, in which are detachably mounted a liquid ink tank 90 storing the ink, and the liquid ejecting head portion 200.

When a drive signal is supplied from a not shown drive signal supply means to the liquid ejecting means on the carriage, the printing liquid is ejected from the liquid ejecting head toward the printing medium depending upon the drive signal.

On the other hand, in the present embodiment of the liquid ejecting apparatus, there are provided a motor as a driving source for driving the printing medium feeding means and the carriage, gears 112 and 113 for transmitting the driving force of the driving source to the carriage, a carriage shaft and so on. By this printing apparatus and the liquid ejecting method to be implemented by the printing apparatus, good image printing product can be obtained by ejecting the liquid toward various printing medium.

The printing apparatus receives a printing information from a host computer 300 as a control signal. The printing information is temporarily stored in an input interface 301 in the printing apparatus, and in conjunction therewith, converted into data to be process in the printing apparatus and then input to a CPU 302 which, in turn, serves as head driving signal supply means. The CPU processes the input data using RAM 304 and other peripheral units on the basis of the control program stored in a ROM 303 to convert into the printing data (image data).

On the other hand, the CPU 302 generates a drive data for driving the driving motor for shifting the printing medium and the printing head in synchronism with the image data so that the image data may be printed at appropriate position on the printing medium. The driving data and the motor driving data are transmitted to respective of head 200 and the driving motor 306 via a head driver 307 and a motor driver 305 for driving them at respective controlled timing to form the image.

If the time period over which the liquid-ejection head has never been used is over a predetermined time or if the preserve mode is selected, the CPU 302 sends a signal to a pump driver 308. Then the pump driver 308 drives a pump 309 according to the received signal, resulting in the replacement of liquid as described in each of the above embodiment. If the step of capping the ejection ports by the cap member is required for the replacement of liquid, the CPU 302 drives the cap member (not shown) through a cap driver (not shown) prior to perform the replacement. A replacement control to be used in the liquid-ejection head described above will be concretely below. In the following description, the replacement is of introducing a liquid to be supplied to a second liquid-flowing passage having a bubble-generating area into a first liquid-flowing passage directly communicating an ejection port, and also of closing the ejection port to forcefully moving the liquid in the second liquid-flowing passage. However, it is not limited to that replacement. It is also possible to apply any of the methods of the respective embodiments described above.

<Driving sequence for the preservation at the time of powering off>

Figure 23:
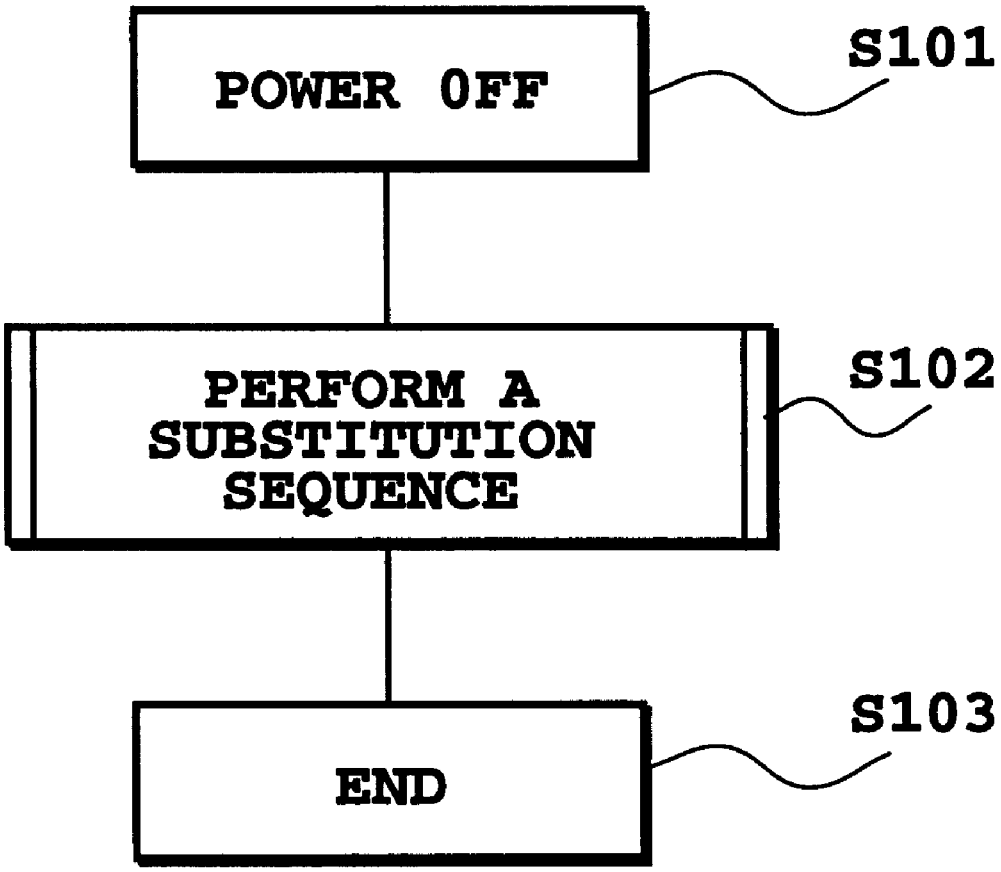
FIG. 23 is a flowchart that illustrates a power-off preservation sequence in accordance with the present invention.

FIG. 23 is a flowchart that illustrates a driving sequence for the preservation when the system receives an instruction of powering off. If the system receives an instruction of powering off (S101), a replacement sequence is performed (S102) as described below. After the completion of the replacement sequence (S103), the system is powered off.

Figure 24:
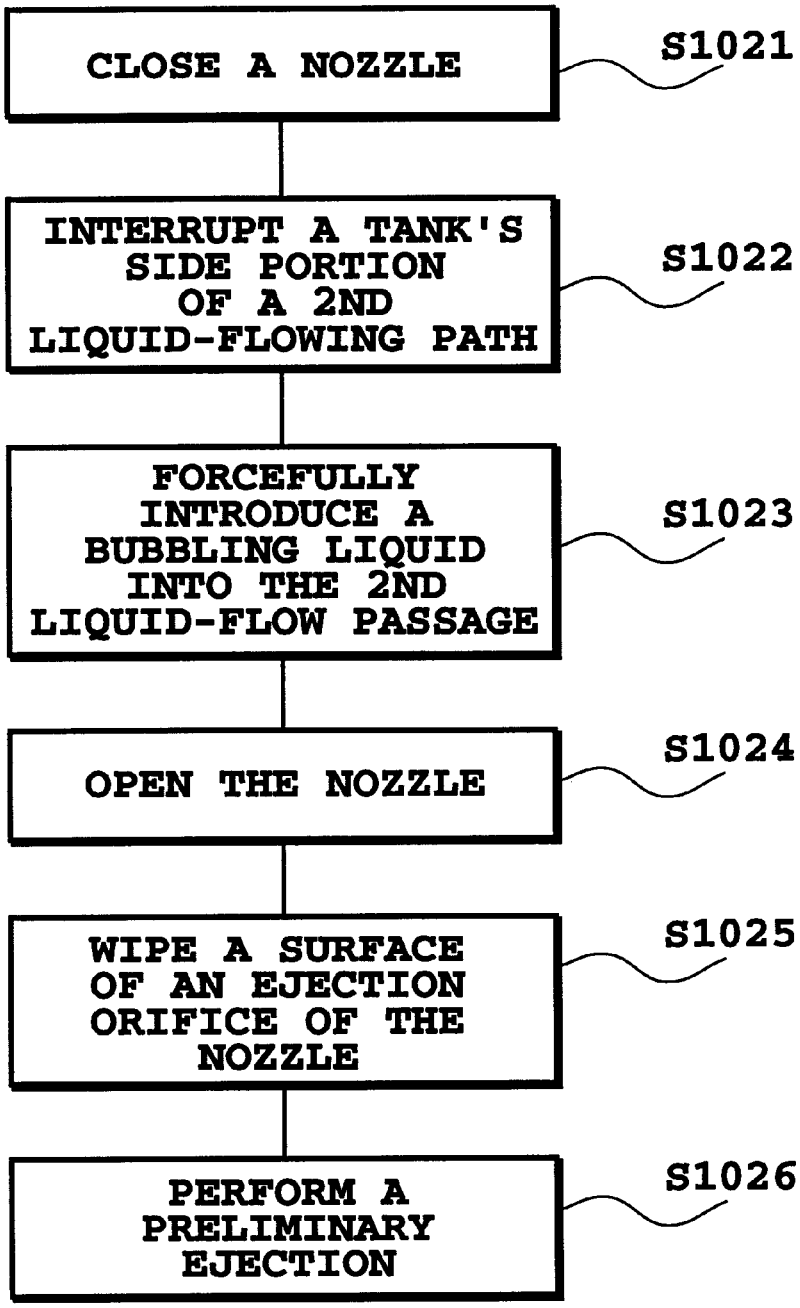
FIG. 24 is a flowchart that illustrates a substitution sequence in accordance with the present invention.

FIG. 24 is a flowchart that illustrates the replacement sequence. In the step of S1021, fist of all, a closing member closes ejection ports of the liquid-ejection head. For preventing a back-flow of a second liquid (i.e., a liquid responsible for generating a bubble) into a liquid-supplying tank, the tank side of the second liquid-flowing passage is blocked. If the tank has any non-return mechanism such as a check valve, there is no need to blocking the passage. In the step of S1023, a pressure pump or the like introduces the second liquid forcefully into the second liquid-flowing passage by generating a compression pressure. Then the liquid flows into a first liquid-flowing passage through a space formed by pushing up a movable member, resulting in the replacement of a first liquid in the first liquid-flowing passage with the second one. The volume of the liquid to be replaced can be previously determined by adjusting a compression pressure to be generated from the compression pump or the like and a duration of applying that pressure to the second liquid. In the step of S1024, the ejection ports are opened. In the step of S1025, a wiping member wipes a surface of an area where the ejection ports are being formed (i.e., an ejection surface). It is possible to end the sequence after the step of S1025, but it is preferable to perform a preliminary ejection if the remainder of the liquid is found on that ejection surface after closing the ejection ports or wiping the ejection surface. In the step of 1026, therefore, the head is driven to perform the preliminary ejection at about five different times.

<Driving sequence for the preservation at the time of measuring an unused period by a timer>

Figure 25:
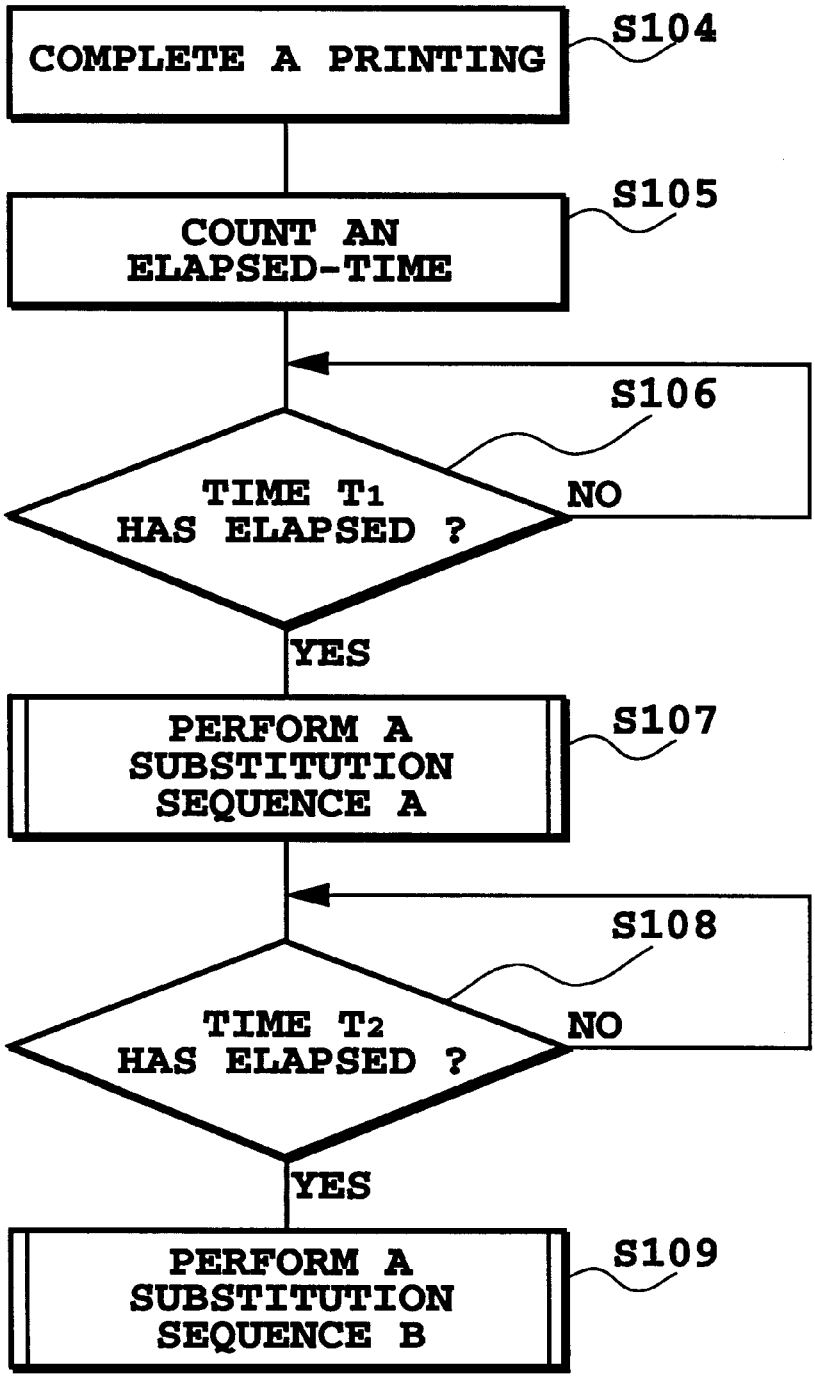
FIG. 25 a flowchart that illustrates a timer-count preservation sequence in accordance with the present invention.

FIG. 25 is a flowchart that illustrates a driving sequence for the replacement according to a value obtained by measuring a time period over which the liquid-ejection head has never been used. In this case, a conventional timer may be used for the measurement.

If the recording is completed (S104), then a timer calculates how much time has elapsed since the completion of recording (S105). The timer determines whether a predetermined time T1 has elapsed or not (S106). If the time T1 has elapsed, then the system performs a replacement sequence of A (S107). If not, on the other hand, the steps S105 and S106 are repeated. Furthermore, the timer determines whether a predetermined time T2 has elapsed since the completion of recording (S108). If the T2 has elapsed, then the system performs a replacement sequence of B (S109). If not, on the other hand, the steps 107 and 108 are repeated. Those sequences of A and B are the same as that of FIG. 23. However, it is preferable that a replacing volume of the liquid in the A sequence is higher than a replacing volume of the liquid in the B sequence from the viewpoint of the time period over which the liquid-ejection head has never been used.

<User-performing preservation sequence>

Figure 26:
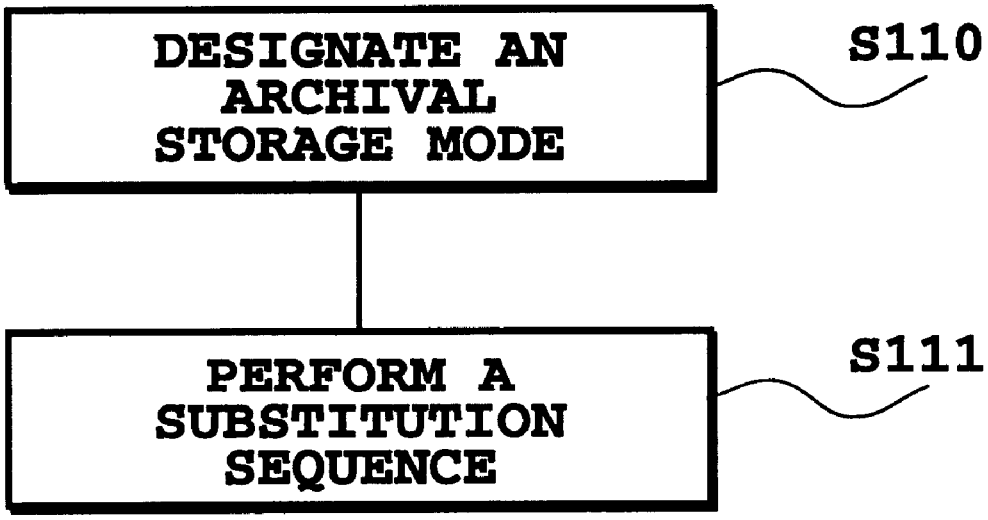
FIG. 26 s a flowchart that illustrates a user preservation sequence in accordance with the present invention.

FIG. 26 is a flowchart that illustrates a preservation sequence to be performed by a user when the liquid-ejection head has not been used or the like. In the step of S111, the user designates a mode for the long term preservation by performing a panel or driver operation. Then the replacement sequence of FIG. 24 is performed according to that designation.

<Return sequence>

Figure 27:
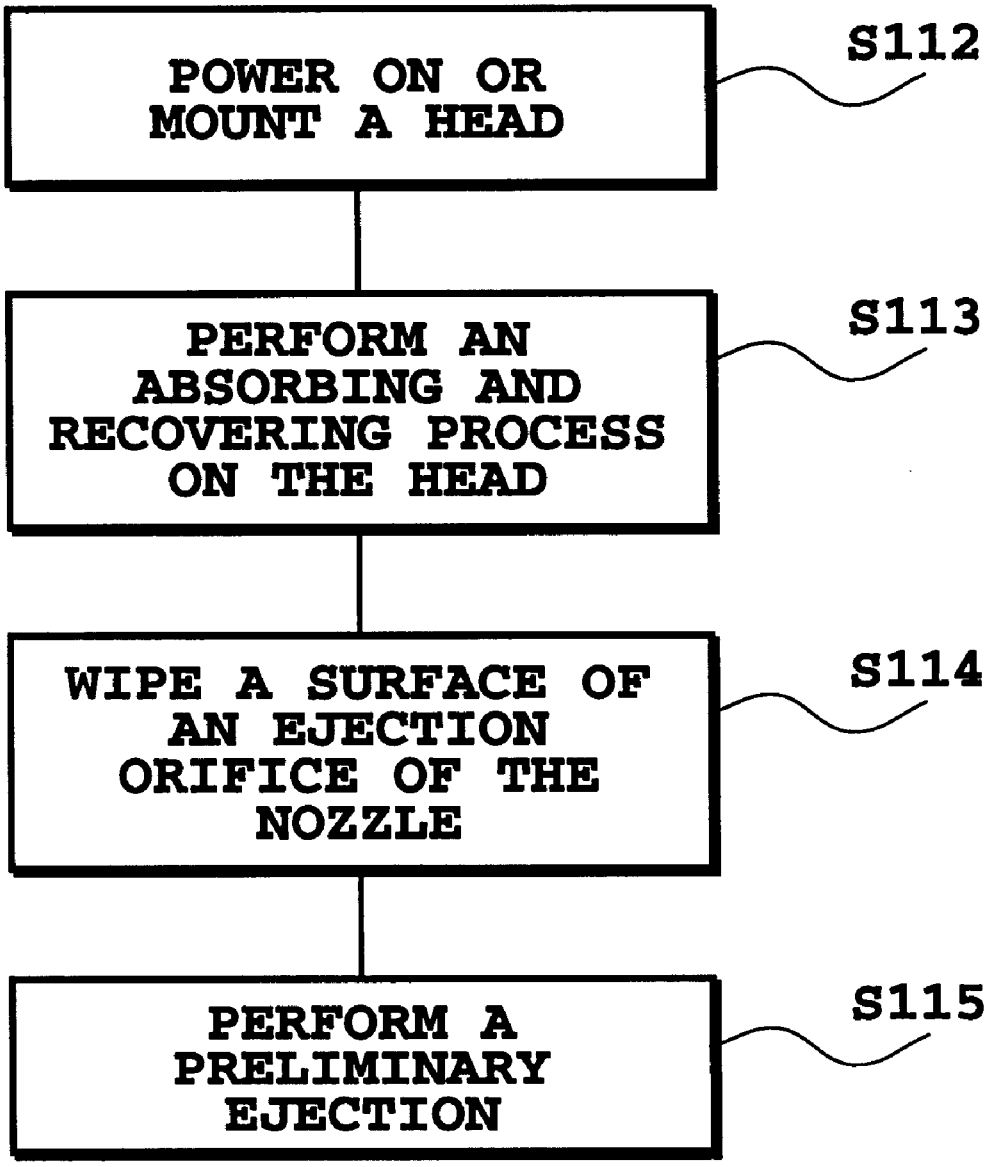
FIG. 27 is a flowchart that illustrates a recovering sequence in accordance with the present invention.

FIG. 27 is a flowchart that illustrates a return sequence for returning the liquid-ejection head, which has not been used for a long time, to its original state.

A recording apparatus is switched on (or a head is attached on the apparatus) after the long term preservation (S112), and then a cap member covers an ejection surface of the head to perform a so-called absorbing recovery operation by which a liquid is absorbed and discharged from the ejection port (S113). As a result, the second liquid being supplied in the first liquid-flowing passage by the replacement is discharged from the ejection port. Then a wipe member wipes the ejection surface to remove the remainder of the second liquid on the ejection surface (S114). A preliminary ejection is repeated about 1,000 to 10,000 times.

<Preservation sequence and recovery sequence at the time of physical distribution>

Figure 28:
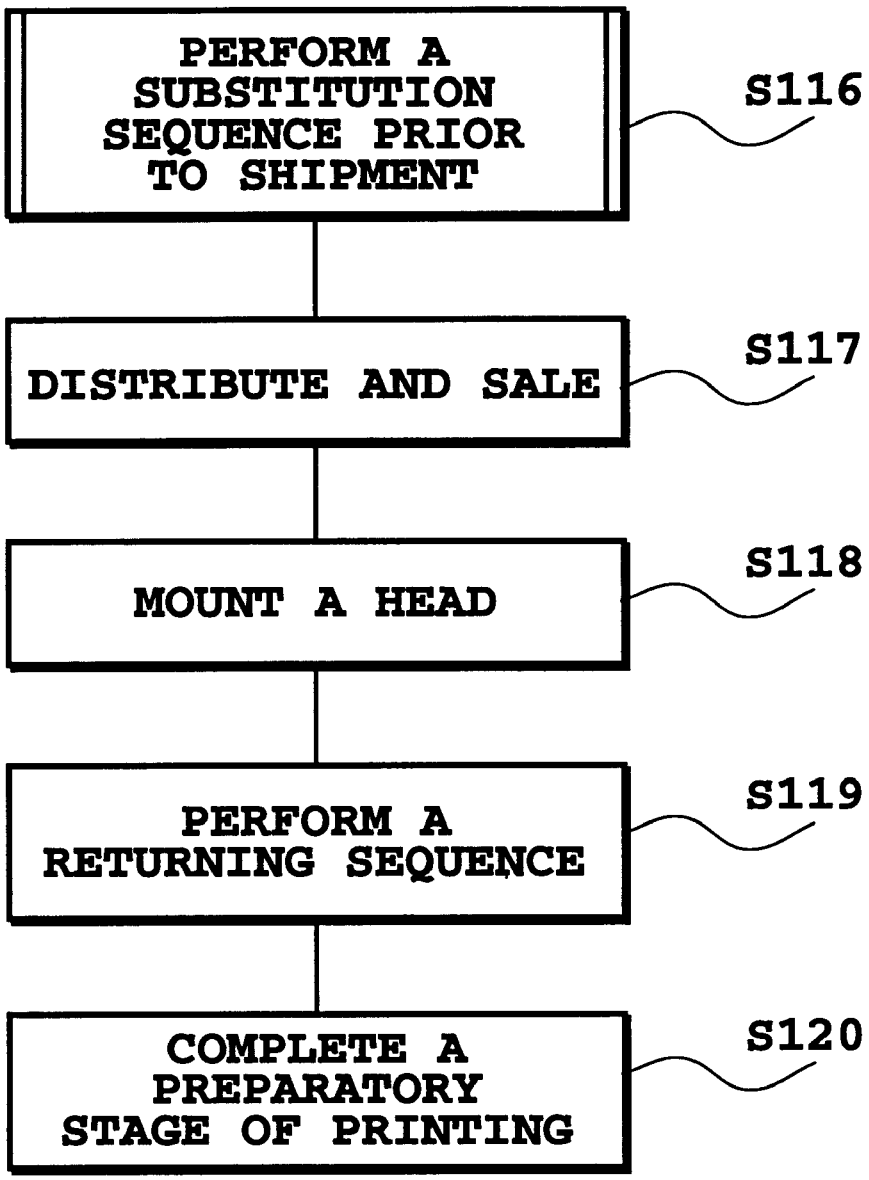
FIG. 28 is a flowchart that illustrates both a physical distribution preservation sequence and a recovering sequence.

Referring now to FIG. 28, preservation sequence and recovery sequence are illustrated in the following description.

Prior to shipment, a manufactured head is subjected to the replacement sequence described above so as to be conditioned to the long term preservation (S116). Then the head in such condition is transported and sold (S117). A user installs head on a system, and then the system automatically checks whether the installation is correctly completed (S118). If it is performed correctly, the user selects a return mode for returning the head to its original state. Then the return sequence described above is performed according to that mode. After the completion of the return sequence, the head is now in a state of readiness to perform the recording procedure (S120). Prior to the shipment or the physical distribution, the head may be connected with an ink cartridge or not.

A recording medium to be used in the recording apparatus described above, on which a liquid such as ink is applied may be one of various kinds of paper, a OHP sheet, a plastic sheet for a compact disc, a decorated plate, or the like, cloth, a metal sheet material such as aluminum or copper, a leather material made of cowhide or pig skin, an artificial leather material, a lumber such as board, plank, or the like, a ceramic material such as earthenware, porcelain, or tile, a bamboo material, a sponge material such as a sponge ball, or the like.

The recording apparatus described above may be selected from a printing apparatus for printing on various paper, OH sheet, and the like; a plastic-recording apparatus for printing on a plastic material to be employed for a compact disk, decorative panel or the like; a textile printing apparatus for printing on cloth; a metal-printing apparatus for printing on a metal material; a leather printing apparatus for printing on a leather; lumber-printing apparatus for printing on a lumber; ceramic-printing apparatus for printing on a ceramic material; and a receding apparatus for printing on a three-dimensional structural body.

Also, as the ejection liquid to be used in these liquid ejecting apparatuses, the liquid adapted to respective printing medium or printing condition may be used.

<Printing System>

Next, one embodiment of an ink-jet printing system to perform printing for the printing medium with using the liquid ejecting head according to the present invention as the printing head.

Figure 29:
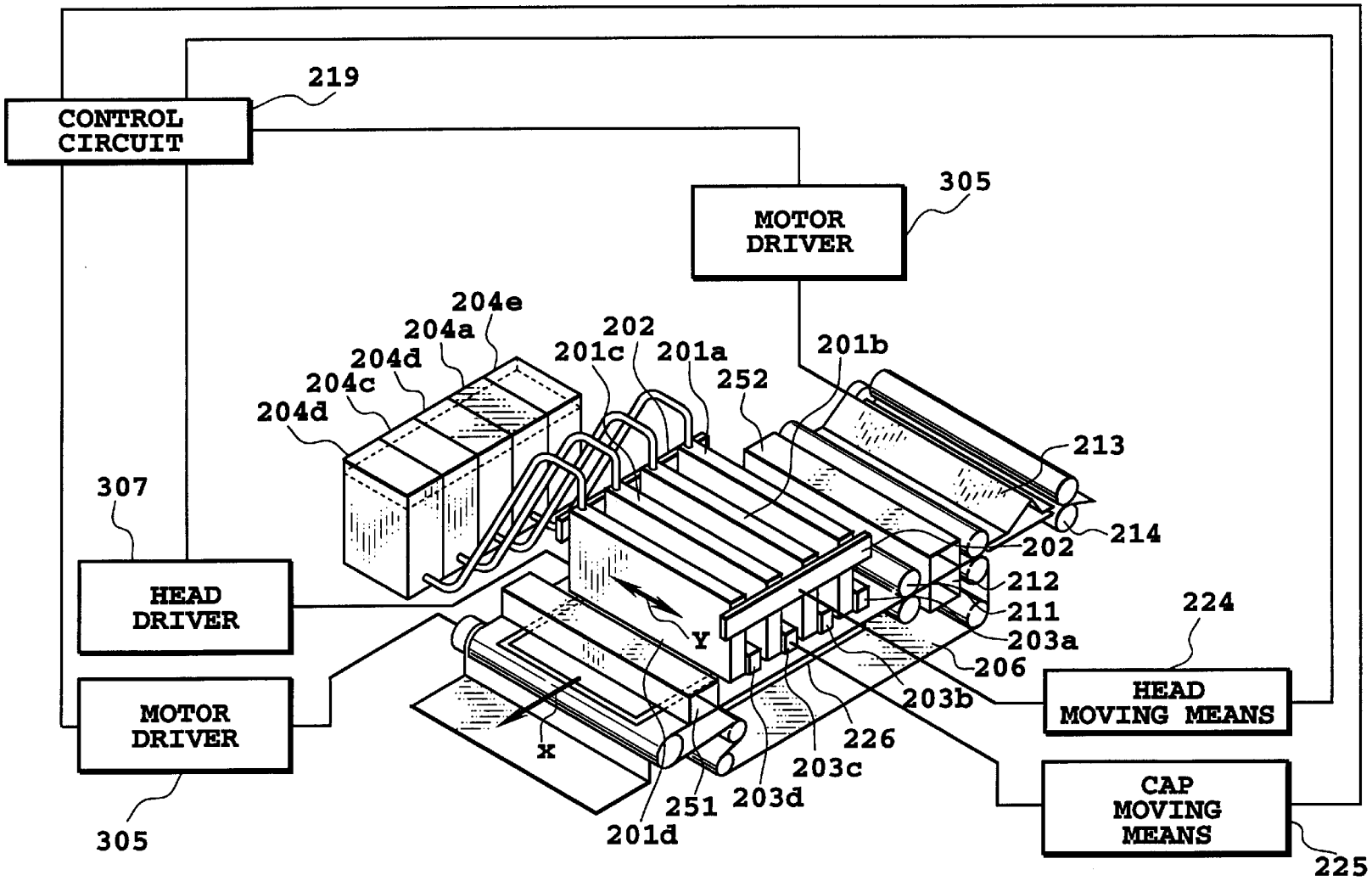
FIG. 29 is a perspective view that shows a liquid-ejection recording system.

FIG. 29 is a diagrammatic illustration for explaining the construction of the ink-jet printing system using the foregoing liquid-ejection head 201 according to the present invention. In the present embodiment, the liquid ejecting head is a full-line type head, in which a plurality of ejection ports at interval of 360 dpi in a length corresponding to a printable width of the printing medium 150, in which four heads respectively corresponding to four colors of yellow (Y), magenta (M), cyan (C) and black (Bk) are fixedly supported in parallel relationship with a given interval in X direction by means of a head holder 202.

With respect to these heads, signal is supplied from the head driver 307 forming respective driving signal supply means. On the basis of this signal, respective head is driven.

For respective heads, four colors of inks of Y, M, C and Bk as ejection liquid are supplied from ink containers 204*a* to 204*d*. The reference numeral 204*e* denotes a bubble-generation liquid container storing the bubble-generation liquid. From this container, bubble-generation liquid is supplied to each head.

At lower side of each head, head caps 203*a* to 203*d*, in which ink absorbing member, such as sponge or so forth is arranged are provided for maintenance of the head by covering the ejection ports of respective heads during non-printing.

The reference numeral 206 denotes a transporting belt forming the transporting means for transporting the various printing medium. The transporting belt 206 runs across a predetermined path defined by various rollers, and is driven by the driving motor connected to the motor driver 305.

In the present embodiment of the ink-jet printing system, before and after printing, a pre-treatment device 251 and a post-treatment device 252 for performing various process for the printing medium are provided upstream and downstream of the printing medium transporting path.

Content of the pre-treatment and the post-treatment are differentiated depending upon kind of the printing medium and kind of the ink. For example, for the printing medium of metal, plastic, ceramic and the like, irradiation of ultraviolet and ozone is performed by pre-treatment to improve adhesion ability of the ink by activating the surface. Also, in the printing medium easily cause static electricity, such as plastic, dust can easily deposit on the surface of the printing medium by static electricity to obstruct high quality printing. As pre-process, static electricity of the printing medium is removed by ionizer device and whereby dust is removed from the printing medium. Also, when cloth is used as the printing medium, in view point of prevention of bleeding, improvement of fixing rate, a material selected from alkaline material, water soluble material, synthetic high polymer, water soluble metal salt, urea and thiourea may be applied to the cloth for pre-treatment. The pre-treatment is not limited to these treatments but can be the treatment for adjusting the temperature of the printing medium to the appropriate temperature.

On the other hand, the post-treatment may be a heat-treatment for the printing medium, for which the ink is applied, a fixing treatment for promoting fixing of the ink by irradiation of ultraviolet ray or the like, treatment for washing the treatment liquid applied in the pre-treatment and left non-reacted.

It should be noted that the full-line head is employed as the head in the present embodiment.

However, the printing head to be employed is not limited to the full-line head but can be in a form where a small size head is shifted in the width direction of the printing medium.

As set forth above, with the liquid ejecting method, head and so on according to the present invention made on the basis of a quite novel principle of ejection, synergistic effect of generation of bubble and movement of the movable member by bubbling can be obtained to permit efficient ejection of the liquid in the vicinity of the ejection port. Therefore, ejection efficiency can be improved in comparison with the ejection method, head and so on of the conventional bubble-jet system. For example, in the most preferred embodiment of the present invention, the significant improvement of ejection efficiency to be double or more of the conventional bubble-jet system can be achieved.

According to characterized construction of the present invention, it becomes possible to avoid ejection failure even by leaving for long period under low temperature and low humidity. Furthermore, even if ejection failure is caused, normal condition can be instantly resumed by slightly performing recovery process, such as preparatory ejection or suction recovery.

With the construction of the present invention, in which re-fill characteristics is improved, response characteristics in continuous ejection, stable growth of bubble, stable formation of liquid droplet, high speed printing by high speed liquid ejection and high quality printing can be achieved.

The conventional bubble-jet ejection is difficult to eject a viscous liquid difficult to form a bubble or a liquid containing a solid content to be easily accumulated. In the present invention, on the other hand, the liquid-ejection head in the type of having two different flow passages has a high degree of flexibility in the selection of an ejection liquid, so that it is able to eject the conventionally unused liquid without any trouble. That is, the high degree of flexibly is depended on a bubble generation liquid. The bubble generation liquid may be a liquid of easily forming a bubble therein and of hardly accumulating or burning a solid content thereof.

According to the present invention, a thermal sensitive liquid can be smoothly ejected, having little effect on heat.

According to the present invention, furthermore, it becomes possible to provide a liquid-ejection apparatus and a method for preserving a liquid-ejection head in the tope of having separated two layers in a single body for supplying a bubble forming liquid and a recording liquid, respectively, to eject the recording liquid smoothly after being left for a long time.

It also becomes possible to provide a method for preventing the adhesion of recording liquid in a head in the tope of having separated two layers in a single body for supplying a bubble forming liquid and a recording liquid.

Furthermore, it becomes possible to provide a method for reducing the amount of ink consumed by reducing the number of ink-absorbing and draining action in head in the tope of having separated two layers in a single body for supplying a bubble forming liquid and a recording liquid.

According to the present invention, still furthermore, it becomes possible to provide a method for starting the use of a head without any troubles by avoiding the adhesion of recording liquid in a liquid-flowing passage of the head in any cases such as in the distribution channels including a shipment and a sale after the production.

It should be noted that the full-line head is employed as the head in the present embodiment.

However, the printing head to be employed is not limited to the full-line head but can be in a form where a small size head is shifted in the width direction of the printing medium.

As set forth above, with the liquid ejecting method, head and so on according to the present invention made on the basis of a quite novel principle of ejection, synergistic effect of generation of bubble and movement of the movable member by bubbling can be obtained to permit efficient ejection of the liquid in the vicinity of the ejection port. Therefore, ejection efficiency can be improved in comparison with the ejection method, head and so on of the conventional bubble-jet system. For example, in the most preferred embodiment of the present invention, the significant improvement of ejection efficiency to be double or more of the conventional bubble-jet system can be achieved.

According to characterized construction of the present invention, it becomes possible to avoid ejection failure even by leaving for long period under low temperature and low humidity. Furthermore, even if ejection failure is caused, normal condition can be instantly resumed by slightly performing recovery process, such as preparatory ejection or suction recovery.

With the construction of the present invention, in which re-fill characteristics is improved, response characteristics in continuous ejection, stable growth of bubble, stable formation of liquid droplet, high speed printing by high speed liquid ejection and high quality printing can be achieved.

The conventional bubble-jet ejection is difficult to eject a viscous liquid difficult to form a bubble or a liquid containing a solid content to be easily accumulated. In the present invention, on the other hand, the liquid-ejection head in the type of having two different flow passages has a high degree of flexibility in the selection of an ejection liquid, so that it is able to eject the conventionally unused liquid without any trouble. That is, the high degree of flexibly is depended on a bubble generation liquid. The bubble generation liquid may be a liquid of easily forming a bubble therein and of hardly accumulating or burning a solid content thereof.

According to the present invention, a thermal sensitive liquid can be smoothly ejected, having little effect on heat.

According to the present invention, furthermore, it becomes possible to provide a liquid-ejection apparatus and a method for preserving a liquid-ejection head in the tope of having separated two layers in a single body for supplying a bubble forming liquid and a recording liquid, respectively, to eject the recording liquid smoothly after being left for a long time.

It also becomes possible to provide a method for preventing the adhesion of recording liquid in a head in the tope of having separated two layers in a single body for supplying a bubble forming liquid and a recording liquid.

Furthermore, it becomes possible to provide a method for reducing the amount of ink consumed by reducing the number of ink-absorbing and draining action in head in the tope of having separated two layers in a single body for supplying a bubble forming liquid and a recording liquid.

According to the present invention, still furthermore, it becomes possible to provide a method for starting the use of a head without any troubles by avoiding the adhesion of recording liquid in a liquid-flowing passage of the head in any cases such as in the distribution channels including a shipment and a sale after the production.

What is claimed is:

1. A method for preserving a liquid-ejection head including:

a first liquid-flowing passage that receives a supply of a first liquid and communicates with an ejection port;

a second liquid-flowing passage that receives a supply of a second liquid that differs from said first liquid;

a bubble generation area formed on said second liquid-flowing passage for heating said second liquid to generate a bubble in said second liquid, whereby the first liquid is ejected in consequence of generation of the bubble; and a movable member positioned between said bubble generation area, having a free end on an ejection port's side of said first liquid-flowing passage and a supporting end on other side of said first liquid-flowing passage, where said free end of said movable member is displaced toward said first liquid-flowing passage by a pressure caused by a generation of said bubble due to heating of said second liquid, comprising a step of:

performing a replacement of one of said first liquid and said second liquid with other at least at a periphery of said ejection port or a periphery of said movable member for preserving the liquid-ejection head.

2. A method as claimed in claim 1, wherein said replacement is performed through a portion communicating between said first liquid-flowing passage and said second liquid-flowing passage.

3. A method as claimed in claim 1, wherein a solidification property of said first liquid is different from a solidification property of said second liquid, and said replacement is performed so as to replace a liquid of a comparatively high solidification property with a liquid of a comparatively low solidification property.

4. A method as claimed in claim 3, wherein a difference between said solidification property of said first liquid and said solidification property of said second liquid is provided as a difference between a viscosity of said first liquid and a viscosity of said second liquid, and said replacement is performed so as to replace a liquid of a comparatively high viscosity with a liquid of a comparatively low viscosity.

5. A method as claimed in claim 3, wherein a difference between said solidification property of said first liquid and said solidification property of said second liquid is provided as a difference between a water resistant property of said first liquid and a water resistant property of said second liquid, and said replacement is performed so as to replace a liquid of a comparatively high water resistant property with a liquid of a comparatively low water resistant property.

6. A method as claimed in claim 1, wherein said replacement is performed by an application of pressure so as to forcefully supply said first liquid in said first liquid-flowing passage into said second liquid in said second liquid-flowing passage or so as to forcefully supply said second liquid in said second liquid-flowing passage into said first liquid in said first liquid-flowing passage.

7. A method as claimed in claim 1, wherein said ejection port is closed prior to said replacement.

8. A method as claimed in claim 1, wherein said replacement is performed after issuing an instruction of powering off said liquid ejection head, and said liquid ejection head is powered off after a completion of said replacement according to said instruction.

9. A method as claimed in claim 1, wherein said replacement is performed after a lapse of a predetermined time from a completion of recording.

10. A method as claimed in claim 1, wherein a heater is formed on a position facing to said movable member, and said bubble generation area is provided as a space between said movable member and said heater.

11. A method as claimed in claim 10, wherein said second liquid-flowing passage has an inner wall with a substantial flatness or with a gentle slope in its upstream side from said heater, and a liquid supply passage for supplying a liquid onto said heater is formed along said inner wall.

12. A method as claimed in claim 10, wherein said free end of said movable member is positioned on a downstream side from an area center of said heater.

13. A method as claimed in claim 10, wherein said bubble is generated by a membrane boiling phenomenon caused in said second liquid in said second liquid-flowing passage by heat generated by a heater.

14. A method as claimed in claim 1, wherein said movable member is shaped like a plate.

15. A method as claimed in claim 14, wherein a whole surface of said heater faces to said movable member.

16. A method as claimed in claim 14, wherein said free end of said movable member is at an ejection port side from said heater.

17. A method as claimed in claim 1, wherein said movable member is constructed as a part of a separation wall arranged between said first liquid-flowing passage and said second liquid-flowing passage.

18. A method as claimed in claim 1, wherein said first liquid-flowing passage is one of a plurality of first liquid-flowing passages that communicate with a first common liquid chamber for supplying a first liquid into each of said first liquid-flowing passages; and said second liquid-flowing passage is one of a plurality of second liquid-flowing passages that communicate with a second common liquid chamber for supplying a second liquid into each of said first liquid-flowing passages.

19. An liquid-ejection apparatus that uses a liquid ejection head for ejecting a liquid onto a recording medium, where said liquid-ejection head has: a first liquid-flowing passage that receives a supply of a first liquid and communicates with an ejection port; a second liquid-flowing passage that receives a supply of a second liquid that differs from said first liquid; a bubble generation area formed on said second liquid-flowing passage for heating said second liquid to generate a bubble in said second liquid, whereby the first liquid is elected in consequence of generation of the bubble; and a movable member positioned between said bubble generation area, having a free end on an ejection port's side of said first liquid-flowing passage and a supporting end on other side of said first liquid-flowing passage, where said free end of said movable member is displaced toward said first liquid-flowing passage by a pressure caused by a generation of said bubble due to heating of said second liquid, comprising:

a replacing means for performing a replacement of one of said first liquid and said second liquid with other at least at a periphery of said ejection port or a periphery of said movable member for preserving the liquid-ejection head.

20. An apparatus as claimed in claim 19, wherein said replacing means is a pressurizing means for closing said ejection port and applying pressure to one of said first liquid and said second liquid.

21. An apparatus as claimed in claim 19, wherein said second liquid-flowing passage has a recovery pass on a downstream side of said bubble generation area.

22. An apparatus as claimed in claim 19, wherein a heater is formed on a position facing to said movable member, and said bubble generation area is provided as a space between said movable member and said heater.

23. An apparatus as claimed in claim 19, wherein said movable member is constructed as a part of a separation wall arranged between said first liquid-flowing passage and said second liquid-flowing passage.

24. An apparatus as claimed in claim 19, wherein:

said first liquid-flowing passage is one of a plurality of first liquid-flowing passages that communicate with a first common liquid chamber for supplying a first liquid into each of said first liquid-flowing passages; and said second liquid-flowing passage is one of a plurality of second liquid-flowing passages that communicate with a second common liquid chamber for supplying a second liquid into each of said first liquid-flowing passages.

25. An apparatus as claimed in claim 19, wherein said first liquid is ink and said recording medium is a sheet of recording paper, and said liquid-ejection head ejects and deposits said ink on said sheet of recording paper to carry out a recording.

26. An apparatus as claimed in claim 19, wherein said first liquid is a printing liquid and said recording medium is a cloth, and said liquid-ejection head ejects and deposits said printing liquid on said cloth to carry out a printing.

27. An apparatus as claimed in claim 22, wherein said free end of said movable member is positioned on a downstream side from an area center of said heater.

28. An apparatus as claimed in claim 22, wherein said second liquid-flowing passage has an inner wall with a substantial flatness or with a gentle slope in its upstream side from said heater, and a liquid supply passage for supplying a liquid onto said heater is formed along said inner wall.

29. An apparatus as claimed in claim 22, wherein said bubble is generated by a membrane boiling phenomenon caused in said second liquid in said second liquid-flowing passage by heat generated by said heater.

30. An apparatus as claimed in claim 22, wherein said movable member is shaped like a plate.

31. An apparatus as claimed in claim 30, wherein a whole surface of said heater faces to said movable member.

32. An apparatus as claimed in claim 30, wherein said free end of said movable member is at an ejection port side from said heater.

33. A recording system having a liquid-ejection apparatus and a post-treatment apparatus for stimulating a fixation of said liquid on said recording medium, where said liquid-ejection apparatus uses a liquid-ejection head that includes: a first liquid-flowing passage that receives a supply of a first liquid and communicates with an ejection port; a second liquid-flowing passage that receives a supply of a second liquid that differs from said first liquid; a bubble generation area formed on said second liquid-flowing passage for heating said second liquid to generate a bubble in said second liquid, whereby the first liquid is ejected in consequence of generation of the bubble; and a movable member positioned between said bubble generation area, having a free end on an ejection port's side of said first liquid flowing passage and a supporting end on other side of said first liquid-flowing passage, where said free end of said movable member is displaced toward said first liquid-flowing passage by a pressure caused by a generation of said bubble due to heating of said second liquid, comprising:

a replacing means for performing a replacement of one of said first liquid and said second liquid with other at least at a periphery of said ejection port or a periphery of said movable member for preserving the liquid-election head.

34. A recording system having a liquid-ejection apparatus and a pre-treatment apparatus for stimulating a fixation of said liquid on said recording medium, where said liquid-ejection apparatus uses a liquid-ejection head that includes: a first liquid-flowing passage that receives a supply of a first liquid and communicates with an ejection port; a second liquid-flowing passage that receives a supply of a second liquid that differs from said first liquid; a bubble generation area formed on said second liquid-flowing passage for heating said second liquid to generate a bubble in said second liquid, whereby the first liquid is ejected in consequence of generation of the bubble; and a movable member positioned between said bubble generation area, having a free end on an ejection port's side of said first liquid-flowing passage and a supporting end on other side of said first liquid-flowing passage, where said free end of said movable member is displaced toward said first liquid-flowing passage by a pressure caused by a generation of said bubble due to heating of said second liquid, comprising:

a replacing means for performing a replacement of one of said first liquid and said second liquid with other at least at a periphery of said ejection port or a periphery of said movable member for preserving the liquid-ejection head.

* * * * *

UNITED STATES PATENT AND TRADEMARK OFFICE

CERTIFICATE OF CORRECTION

PATENT NO. : 6,095,639
DATED : August 1, 2000
INVENTOR(S) : Masaya Uetsuki et al.

It is certified that error appears in the above-identified patent and that said Letters Patent is hereby corrected as shown below:

Column 3,
Line 3, "ultrasonically" should read -- ultrasonic --;
Line 19, "is" should be deleted.

Column 4,
Line 41, "may be of having" should read -- could have --;
Line 43, "may be of having" should read -- could have --.

Column 5,
Line 9, "flesh" should read -- fresh --;
Line 15, "difficultly" should read -- difficult --;
Line 24, "tope" should read -- hope --;
Line 30, "tope" should read -- hope --;
Line 36, "tope" should read --hope --;
Line 38, "forth" should read -- fourth --.

Column 7,
Line 2, "an" should read -- a --;
Line 19, "fist" should read -- first --.

Column 8,
Line 21, "fist" should read -- first --;
Line 44, "fist" should read -- first --.

Column 9,
Line 44, "FIG. 17" should read -- FIG. 17A --.

Column 11,
Line 44, "wall 35" should read -- wall 34 --.

Column 12,
Line 18, "act on" should read -- acted on --;
Line 19, "to" (first occurrence) should be deleted.

UNITED STATES PATENT AND TRADEMARK OFFICE

CERTIFICATE OF CORRECTION

PATENT NO. : 6,095,639
DATED : August 1, 2000
INVENTOR(S) : Masaya Uetsuki et al.

It is certified that error appears in the above-identified patent and that said Letters Patent is hereby corrected as shown below:

Column 16,
Line 19, "in" should be deleted.

Column 18,
Line 27, "the" (second occurrence) should be deleted;
Line 61, "been" should be deleted.

Column 19,
Line 8, "fist" should read -- first --;
Line 9, "more easy" should read -- easier --;
Line 35, "firmer" should read -- former --;
Line 43, "be" should be deleted.

Column 20,
Line 17, "fist" should read -- first --;
Line 27, "firmer" should read -- former --;
Line 32, "be" should be deleted.

Column 21,
Line 13, "be" should be deleted.

Column 22,
Line 21, "firmer" should read -- former --;
Line 28, "be" should be deleted;
Line 44, "it is not" should read -- it does not --.

Column 25,
Line 59, "later" should read -- layer --.

Column 26,
Line 32, "ejection" should read -- ejected --;
Line 50, "is" should be deleted.

Column 27,
Line 62, "to the" (first occurrence) should be deleted.

UNITED STATES PATENT AND TRADEMARK OFFICE

CERTIFICATE OF CORRECTION

PATENT NO. : 6,095,639
DATED : August 1, 2000
INVENTOR(S) : Masaya Uetsuki et al.

It is certified that error appears in the above-identified patent and that said Letters Patent is hereby corrected as shown below:

Column 28,
Line 15, "to" should read -- the --;
Line 25, "results" should read -- result --;
Line 63, "is easily cause" should read -- easily causes --.

Column 29,
Line 2, "in nature" should read -- nature --.

Column 30,
Line 59, "process" should read -- processed --.

Column 31,
Line 18, "concretely" should read -- explained --;
Line 36, "fist" should read -- first --;
Line 42, "blocking" should read -- block --.

Column 34,
Line 61, "tope" should read -- hope --;
Line 67, "tope" should read -- hope --.

UNITED STATES PATENT AND TRADEMARK OFFICE

CERTIFICATE OF CORRECTION

PATENT NO. : 6,095,639
DATED : August 1, 2000
INVENTOR(S) : Masaya Uetsuki et al.

It is certified that error appears in the above-identified patent and that said Letters Patent is hereby corrected as shown below:

Column 35,
Line 6, "tope" should read -- hope --;
Line 57, "tope" should read -- hope --;
Line 63, "tope" should read -- hope --.

Column 36,
Line 2, "tope" should read -- hope --.

Signed and Sealed this

Twenty-seventh Day of November, 2001

*Attest:*

Nicholas P. Godici

*Attesting Officer*

NICHOLAS P. GODICI
*Acting Director of the United States Patent and Trademark Office*

UNITED STATES PATENT AND TRADEMARK OFFICE

CERTIFICATE OF CORRECTION

PATENT NO. : 6,095,639
DATED : August 1, 2000
INVENTOR(S) : Masaya Uetsuki et al.

It is certified that error appears in the above-identified patent and that said Letters Patent is hereby corrected as shown below:

Column 3,
Line 3, "ultrasonically" should read -- ultrasonic --;
Line 19, "is" should be deleted.

Column 4,
Line 41, "may be of having" should read -- could have --;
Line 43, "may be of having" should read -- could have --.

Column 5,
Line 9, "flesh" should read -- fresh --;
Line 15, "difficultly" should read -- difficult --;
Line 24, "tope" should read -- hope --;
Line 30, "tope" should read -- hope --;
Line 36, "tope" should read --hope --;
Line 38, "forth" should read -- fourth --.

Column 7,
Line 2, "an" should read -- a --;
Line 19, "fist" should read -- first --.

Column 8,
Line 21, "fist" should read -- first --;
Line 44, "fist" should read -- first --.

Column 9,
Line 44, "FIG. 17" should read -- FIG. 17A --.

Column 11,
Line 44, "wall 35" should read -- wall 34 --.

Column 12,
Line 18, "act on" should read -- acted on --;
Line 19, "to" (first occurrence) should be deleted.

UNITED STATES PATENT AND TRADEMARK OFFICE

CERTIFICATE OF CORRECTION

PATENT NO. : 6,095,639
DATED : August 1, 2000
INVENTOR(S) : Masaya Uetsuki et al.

It is certified that error appears in the above-identified patent and that said Letters Patent is hereby corrected as shown below:

Column 16,
Line 19, "in" should be deleted.

Column 18,
Line 27, "the" (second occurrence) should be deleted;
Line 61, "been" should be deleted.

Column 19,
Line 8, "fist" should read -- first --;
Line 9, "more easy" should read -- easier --;
Line 35, "firmer" should read -- former --;
Line 43, "be" should be deleted.

Column 20,
Line 17, "fist" should read -- first --;
Line 27, "firmer" should read -- former --;
Line 32, "be" should be deleted.

Column 21,
Line 13, "be" should be deleted.

Column 22,
Line 21, "firmer" should read -- former --;
Line 28, "be" should be deleted;
Line 44, "it is not" should read -- it does not --.

Column 25,
Line 59, "later" should read -- layer --.

Column 26,
Line 32, "ejection" should read -- ejected --;
Line 50, "is" should be deleted.

Column 27,
Line 62, "to the" (first occurrence) should be deleted.

UNITED STATES PATENT AND TRADEMARK OFFICE

CERTIFICATE OF CORRECTION

PATENT NO. : 6,095,639
DATED : August 1, 2000
INVENTOR(S) : Masaya Uetsuki et al.

It is certified that error appears in the above-identified patent and that said Letters Patent is hereby corrected as shown below:

Column 28,
Line 15, "to" should read -- the --;
Line 25, "results" should read -- result --;
Line 63, "is easily cause" should read -- easily causes --.

Column 29,
Line 2, "in nature" should read -- nature --.

Column 30,
Line 59, "process" should read -- processed --.

Column 31,
Line 18, "concretely" should read -- explained --;
Line 36, "fist" should read -- first --;
Line 42, "blocking" should read -- block --.

Column 34,
Line 61, "tope" should read -- hope --;
Line 67, "tope" should read -- hope --.

UNITED STATES PATENT AND TRADEMARK OFFICE

CERTIFICATE OF CORRECTION

PATENT NO. : 6,095,639
DATED : August 1, 2000
INVENTOR(S) : Masaya Uetsuki et al.

It is certified that error appears in the above-identified patent and that said Letters Patent is hereby corrected as shown below:

Column 35,
Line 6, "tope" should read -- hope --;
Line 57, "tope" should read -- hope --;
Line 63, "tope" should read -- hope --.

Column 36,
Line 2, "tope" should read -- hope --.

Column 38,
Line 1, "elected" should read -- ejected --.

This certificate supersedes Certificate Of Correction issued November 27, 2001

Signed and Sealed this

Fifth Day of February, 2002

*Attest:*

*Attesting Officer*

JAMES E. ROGAN
*Director of the United States Patent and Trademark Office*